US010754265B2

(12) United States Patent
Yamauchi et al.

(10) Patent No.: US 10,754,265 B2
(45) Date of Patent: Aug. 25, 2020

(54) IMAGE FORMING APPARATUS

(71) Applicant: CANON KABUSHIKI KAISHA, Tokyo (JP)

(72) Inventors: Hisashi Yamauchi, Numazu (JP); Keitaro Nakata, Suntou-gun (JP); Yasukazu Ikami, Tokyo (JP); Kosuke Ikada, Machida (JP); Kentaro Yamawaki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/679,459

(22) Filed: Nov. 11, 2019

(65) Prior Publication Data

US 2020/0150578 A1 May 14, 2020

(30) Foreign Application Priority Data

Nov. 14, 2018 (JP) ..... 2018-213876

(51) Int. Cl.

| | |
|---|---|
| ***G03G 21/00*** | (2006.01) |
| ***G03G 5/04*** | (2006.01) |
| ***G03G 5/06*** | (2006.01) |

(52) U.S. Cl.

CPC ..... *G03G 5/06* (2013.01); *G03G 5/04* (2013.01); *G03G 21/0029* (2013.01)

(58) Field of Classification Search

CPC ..... G03G 5/04; G03G 5/06; G03G 21/0029
See application file for complete search history.

(56) References Cited

U.S. PATENT DOCUMENTS

| | | | | |
|---|---|---|---|---|
| 5,242,776 | A | 9/1993 | Doi | |
| 5,635,324 | A * | 6/1997 | Rasmussen | G03G 5/10 430/127 |
| 6,051,148 | A * | 4/2000 | Perry | G03G 5/102 216/102 |

(Continued)

FOREIGN PATENT DOCUMENTS

| | | | |
|---|---|---|---|
| JP | 2001066814 | A | 3/2001 |
| JP | 4027407 | B2 | 12/2007 |
| JP | 2016090620 | A | 5/2016 |

OTHER PUBLICATIONS

Extended European Search Report issued in European Appln. No. 19208482.0 dated Mar. 26, 2020.

*Primary Examiner* — Ryan D Walsh
(74) *Attorney, Agent, or Firm* — Rossi, Kimms & McDowell LLP

(57) ABSTRACT

An image forming apparatus including: an image bearing member; a developing member to supply a developer to the image bearing member; and a cleaning member to clean a peripheral surface of the image bearing member in contact with the peripheral surface, wherein a plurality of grooves extend in a circumferential direction on the peripheral surface, and have a width in a generatrix direction of the peripheral surface within a range of at least 0.5 μm and not more than 40 μm, and are formed to be side by side in the generatrix direction; the number of the grooves is at least 20 and not more than 1000 per a width of 1000 μm in the generatrix direction of the peripheral surface; and an average depth (Rvk) of a valley of a projection under a core section of a roughness curve of the peripheral surface is 0.08 μm or less.

9 Claims, 6 Drawing Sheets

(56) References Cited

U.S. PATENT DOCUMENTS

| | | | | |
|---|---|---|---|---|
| 7,186,489 | B2 | 3/2007 | Uematsu | |
| 2006/0008717 | A1 | 1/2006 | Uematsu | |
| 2007/0224530 | A1* | 9/2007 | Kobori | G03G 9/09708 430/100 |
| 2007/0231511 | A1* | 10/2007 | Okuda | B41M 5/52 428/32.34 |
| 2012/0148309 | A1 | 6/2012 | Oshima | |
| 2012/0196213 | A1 | 8/2012 | Aoyagi | |
| 2014/0086624 | A1 | 3/2014 | Kojima | |
| 2015/0241799 | A1* | 8/2015 | Takahashi | G03G 5/04 430/56 |
| 2017/0212469 | A1 | 7/2017 | Kawakami | |

* cited by examiner

IMAGE FORMING APPARATUS

BACKGROUND OF THE INVENTION

Field of the Invention

The present invention relates to an electrophotographic image forming apparatus. Here, the electrophotographic image forming apparatus (hereinafter also simply referred to as "image forming apparatus") refers to an apparatus in which an image on a recording material (recording medium) is formed using an electrophotographic image forming system. Examples of the image forming apparatus include a copying machine, a printer (laser beam printer, LED printer, and the like), a facsimile machine, a word processor, and a multifunction machine (multifunction printer) thereof.

Description of the Related Art

In an image forming apparatus of an electrophotographic system, a developing device develops an electrostatic latent image formed on a photosensitive drum, which is an image bearing member, into a toner image with a developer, and the toner image is transferred from the photosensitive drum to a recording material and sequentially fixed to obtain an image. Among color image forming apparatuses, an image forming apparatus of an intermediate transfer belt system in which a toner image is transferred from a photosensitive drum to an intermediate transfer belt and then the toner image is transferred again from the intermediate transfer belt to the recording material has been put into practical use.

In the transfer step from the photosensitive drum to the intermediate transfer belt, the toner charged with a polarity opposite to the normal polarity or the toner having a low charge quantity may remain on the photosensitive drum without being transferred in the transfer step. As a device for removing the residual toner, a cleaning device is used that removes the residual toner by bringing a cleaning member into contact with the photosensitive drum.

These developing device, photosensitive drum, and cleaning device may be integrally configured as a process cartridge that can be attached to and detached from the image forming apparatus.

As a cleaning means, a counter-type blade cleaning in which a cleaning blade made of an elastic portion is brought into contact in a counter direction with respect to the rotation direction of the photosensitive drum is widely used from the viewpoint of simplicity of configuration and removal capability.

In the counter type blade cleaning, the cleaning blade is strongly brought into contact with and rubbed against the photosensitive drum. For this reason, the driving torque of the photosensitive drum accounts for a larger part of the process cartridge driving torque.

For example, Japanese Patent No. 4027407 discloses torque reduction in blade cleaning aimed at the reduction of power consumption by reducing the driving torque of an image forming apparatus on which a process cartridge is mounted and the downsizing of the image forming apparatus and devices. Japanese Patent No. 4027407 indicates that the surface roughness of the photosensitive drum is controlled. Here, the torque is reduced by reducing the contact surface area between the cleaning blade and the photosensitive drum.

SUMMARY OF THE INVENTION

However, in the image forming apparatus described above, from the viewpoint of improving the cleaning efficiency and extending the life of the apparatus, it is necessary to further reduce the driving torque.

Meanwhile, in recent years, in order to further reduce the driving torque of the photosensitive drum with the object of further reducing the power consumption, it is required to reduce the amount of penetration of the cleaning blade in a state of contact with the photosensitive drum. However, in Japanese Patent No. 4027407, it is found that where the amount of penetration of the cleaning blade into the photosensitive drum is reduced, the toner may slip off from the cleaning blade and contaminate the charging member, and image defects such as vertical streaks may occur.

An object of the present invention is to provide an image forming apparatus capable of suppressing the occurrence of image problems caused by contamination of a charging member in a state where the driving torque of a photosensitive drum is lowered.

In order to achieve the object described above, an image forming apparatus including:

- a cylindrical image bearing member including a cylindrical support and an organic photosensitive layer provided on the cylindrical support;
- a developing member configured to supply a developer to the image bearing member for developing a latent image formed on a peripheral surface of the image bearing member; and
- a cleaning member configured to clean the peripheral surface in contact with the peripheral surface of the image bearing member,
- wherein a plurality of grooves extend in a circumferential direction on the peripheral surface of the image bearing member, and have a width in a generatrix direction of the peripheral surface within a range of at least 0.5 μm and not more than 40 μm, and are formed to be side by side in the generatrix direction;
- the number of the grooves is at least 20 and not more than 1000 per a width of 1000 μm in the generatrix direction of the peripheral surface of the image bearing member; and
- an average depth (Rvk) of a valley of a projection under a core section of a roughness curve of the peripheral surface of the image bearing member is 0.08 μm or less.

According to the present invention, it is possible to provide an image forming apparatus capable of suppressing the occurrence of image problems caused by contamination of a charging member in a state where the driving torque of a photosensitive drum is lowered.

Further features of the present invention will become apparent from the following description of exemplary embodiments with reference to the attached drawings.

DESCRIPTION OF THE EMBODIMENTS

In each embodiment, the description of "at least XX and not more than XX" or "XX to XX" representing a numerical range means a numerical range including a lower limit and an upper limit as end points, unless otherwise specified.

Hereinafter, exemplary embodiments or examples will be described in detail with reference to the drawings. However, since the dimensions, materials, shapes, relative positions, etc. of the components described in the embodiments or examples are changed, as appropriate, depending on the configuration of the apparatus to which the invention is applied and various conditions, the scope of the invention is not intended to be limited only thereto, as long as it is not specifically indicated otherwise.

Embodiment 1

Image Forming Apparatus

Figure 1:
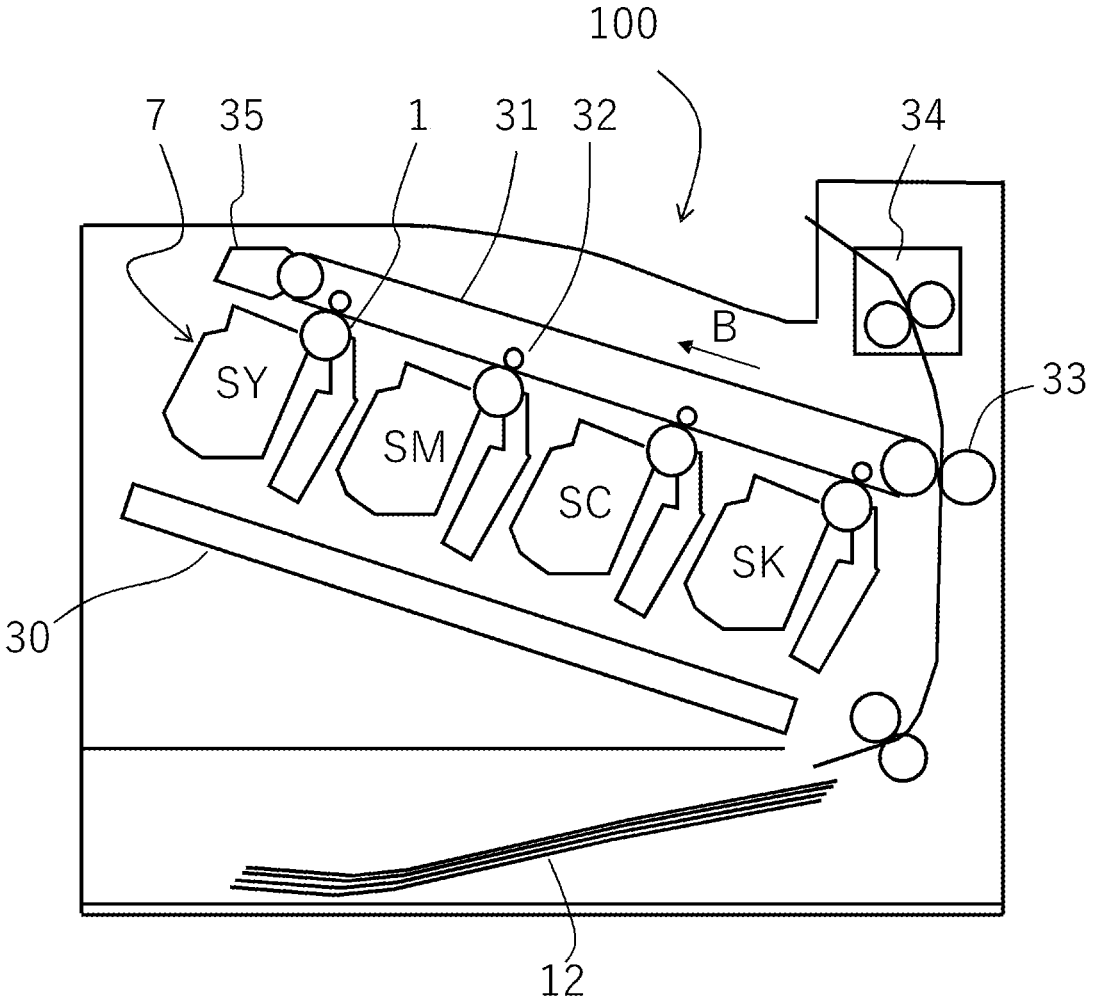
FIG. 1 is a schematic cross-sectional view of an image forming apparatus according to an embodiment.

The overall configuration of the electrophotographic image forming apparatus (image forming apparatus) according to Embodiment 1 will be described with reference to FIG. 1. FIG. 1 is a schematic cross-sectional view of an image forming apparatus 100 of the present embodiment. Examples of the image forming apparatus to which the present invention can be applied include a copying machine and a printer using an electrophotographic system. In the case explained herein, the present invention is applied to a full-color laser beam printer using a tandem system and an intermediate transfer system as the image forming apparatus 100 of the present embodiment.

The image forming apparatus 100 can form a full-color image on a recording material (for example, recording paper, plastic sheet, cloth, and the like) according to image information. The image information is inputted to the image forming apparatus main body from an image reading device connected to the image forming apparatus main body or a host device such as a personal computer communicably connected to the image forming apparatus main body.

In the image forming apparatus 100, process cartridges 7 as a plurality of image forming units have first to fourth image forming units SY, SM, SC, SK for forming yellow (Y), magenta (M), cyan (C), and black (K) images, respectively. In the present embodiment, the first to fourth image forming units SY, SM, SC, and SK are arranged in a row in a direction that intersects the vertical direction.

Further, in the present embodiment, the configurations and operations of the first to fourth image forming units SY, SM, SC, SK are substantially the same except that the colors of images to be formed are different. Therefore, in the following general explanation, the symbols Y, M, C, K given to the reference numerals to indicate that they are elements provided for a certain color are omitted, unless there is a particular distinction.

The process cartridge 7 can be attached to and detached from the image forming apparatus 100 by using mounting means such as a mounting guide and a positioning member provided at the image forming apparatus main body. In the present embodiment, the process cartridges 7 for the respective colors all have the same shape, and the process cartridge 7 for each color accommodates a toner (developer) of respective color: yellow (Y), magenta (M), cyan (C), and black (K). In the present embodiment, a configuration in which the process cartridge can be detachably attached to the apparatus main body will be described. However, a developing unit 3 (see FIG. 2) alone may be configured to be detachably attachable to the image forming apparatus main body.

A photosensitive drum 1 as an image bearing member that bears an electrostatic image (electrostatic latent image) is rotationally driven by a driving means (drive source) not shown in the figure. The image forming apparatus 100 is provided with a scanner unit (exposure device) 30. The scanner unit 30 is an exposure means for emitting a laser beam on the basis of image information to form an electrostatic image (electrostatic image) on the photosensitive drum 1. Further, in the image forming apparatus 100, an intermediate transfer belt 31 as an intermediate transfer body for transferring the toner image on the photosensitive drum 1 to a recording material 12 is disposed so as to face the four photosensitive drums 1.

The intermediate transfer belt 31 formed of an endless belt as an intermediate transfer member is in contact with all the photosensitive drums 1 and circulates (rotates) in the direction indicated by an arrow B (counterclockwise) in the figure.

On the inner circumferential surface side of the intermediate transfer belt 31, four primary transfer rollers 32 serving as primary transfer means are arranged side in side so as to face the respective photosensitive drums 1. A voltage having a polarity opposite to the normal charging polarity of the toner is applied to the primary transfer roller 32 from a primary transfer bias power source (high-voltage power source) as a primary transfer bias applying means (not shown). As a result, the toner image on the photosensitive drum 1 is transferred (primary transfer) onto the intermediate transfer belt 31.

Further, a secondary transfer roller 33 as a secondary transfer unit is disposed on the outer circumferential surface side of the intermediate transfer belt 31. A voltage having a polarity opposite to the normal charging polarity of the toner is applied to the secondary transfer roller 33 from a secondary transfer bias power source (high-voltage power source) as a secondary transfer bias applying means (not shown). As a result, the toner image on the intermediate transfer belt 31 is transferred (secondary transfer) to the recording material 12. For example, when forming a full-color image, the above-described process is sequentially performed in the image forming units SY, SM, SC, SK, and the toner images of respective colors are sequentially superimposed and primarily transferred onto the intermediate transfer belt 31. Thereafter, the recording material 12 is conveyed to the secondary transfer portion in synchronization with the movement of the intermediate transfer belt 31. The four-color toner image on the intermediate transfer belt 31 is secondarily transferred as a whole onto the recording material 12 by the action of the secondary transfer roller 33 which is in contact with the intermediate transfer belt 31 with the recording material 12 being interposed therebetween.

The recording material 12 to which the toner image has been transferred is conveyed to a fixing device 34 as a fixing means. The toner image is fixed on the recording material 12 by applying heat and pressure to the recording material 12 in the fixing device 34.

The toner remaining in the secondary transfer process is conveyed to a cleaning device 35 as a cleaning means. In the cleaning device 35, the residual toner is scraped off from the intermediate transfer belt 31 by a cleaning blade (not shown) located inside the cleaning device 35, and the scraped toner is conveyed from the cleaning device 35 to a toner recovery container (not shown) and stored.

Process Cartridge

The overall configuration of the process cartridge 7 mounted on the image forming apparatus of the present embodiment will be described hereinbelow.

Figure 2:
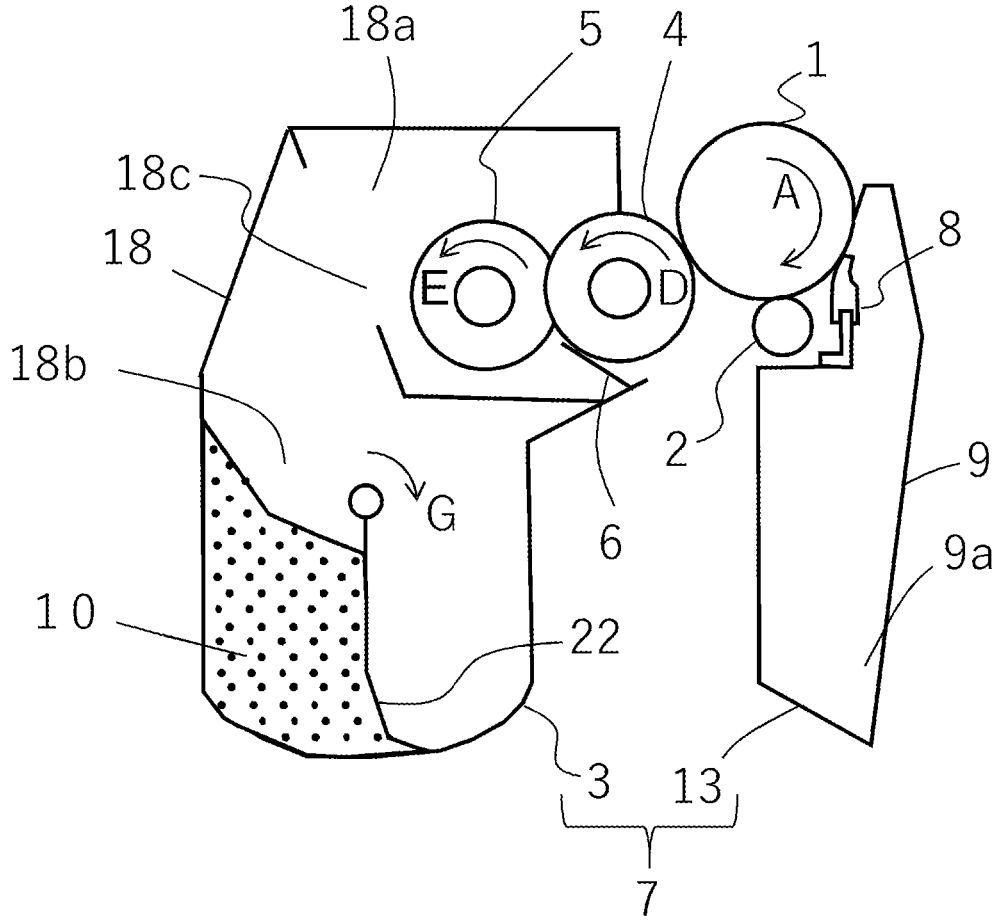
FIG. 2 is a schematic sectional view of a process cartridge according to the embodiment.

FIG. 2 is a cross-sectional view (main cross-sectional view) of the process cartridge 7 of the present embodiment taken along the longitudinal direction (rotational axis direction) of the photosensitive drum 1. In the present embodiment, the configuration and operation of the process cartridge 7 for each color are substantially the same except for the type (color) of the developer stored therein. Each operation in the present embodiment is controlled by a control unit (control means) of a CPU (not shown).

The process cartridge 7 includes a developing unit 3 equipped with a developing roller 4 as a developing portion and the like and a photosensitive member unit 13 equipped with a photosensitive drum 1 and the like.

The developing unit 3 includes the developing roller 4, a toner supply roller 5, a toner conveying member 22, and a developing frame 18 that rotatably supports them. The developing frame 18 includes a development chamber 18*a* in which the developing roller 4 and the toner supply roller 5 are disposed, and a developer storage chamber 18*b* in which the toner 10 is stored. The development chamber 18*a* and the developer storage chamber 18*b* communicate with each other through an opening 18*c*. The developer storage chamber 18*b* is disposed below the development chamber 18*a*. In the developer storage chamber 18*b*, the toner 10 serving as a developer is stored. In the present embodiment, the normal charging polarity of the toner 10 is negative. Here, the normal charging polarity is a charging polarity for developing an electrostatic image. In the present embodiment, since the negative electrostatic image is reversely developed, the normal charging polarity of the toner is negative. However, the present invention is not limited to the negatively chargeable toner.

The developer storage chamber 18*b* is provided with the toner conveying member 22 for conveying the toner 10 to the development chamber 18*a*. As the toner conveying member rotates in the direction of arrow G in the figure, the toner 10 is conveyed to the development chamber 18*a*.

The development chamber 18*a* is provided with the developing roller 4 as a developer bearing member that contacts the photosensitive drum 1 and rotates in the direction of the arrow D shown in the drawing. In the present embodiment, the developing roller 4 and the photosensitive drum 1 rotate so that their surfaces move in the same direction at the facing portion, that is, so that the rotation directions thereof are opposite to each other. A voltage sufficient to develop and visualize the electrostatic image on the photosensitive drum 1 as a toner image is applied to the developing roller 4 from a first power supply (high-voltage power supply) (not shown) serving as a first voltage applying means.

Further, a toner supply roller (hereinafter simply referred to as "supply roller") 5 as a developer supply member that supplies the toner 10 conveyed from the toner storage chamber 18*b* to the developing roller 4 is disposed inside the development chamber 18*a*. Disposed therein is also a developer amount regulating member (hereinafter simply referred to as "regulating member") 6 that regulates the coat amount of the toner on the developing roller 4 supplied by the supply roller 5 and performs charge application.

The supply roller 5 is an elastic sponge roller having a conductive mandrel and a foam layer on the surface. The supply roller 5 is disposed to form a contact portion between the supply roller and the developing roller 4, and rotates in the direction of the arrow E in the drawing. However, the rotation direction of the supply roller 5 may be opposite to E.

Further, a voltage is applied to the supply roller 5 from a second power source (high-voltage power source) (not shown) as a second voltage applying means.

The toner 10 supplied to the developing roller 4 by the supply roller 5 enters the contact portion between the regulating member 6 and the developing roller 4 as a result of rotation of the developing roller 4 in the arrow D direction. The toner 10 is triboelectrically charged and imparted with an electric charge by rubbing between the developing roller 4 and the regulating member 6, and at the same time, the toner layer thickness is regulated. The regulated toner 10 on the developing roller 4 is conveyed to a portion facing the photosensitive drum 1 by the rotation of the developing roller 4, and the electrostatic image on the photosensitive drum 1 is developed and visualized as a toner image.

Meanwhile, the photosensitive member unit 13 includes a cleaning frame 9 as a frame that supports various components of the photosensitive member unit 13 such as the photosensitive drum 1. The photosensitive drum 1 is rotatably attached to the cleaning frame 9 through a bearing (not shown). The photosensitive drum 1 is an organic photosensitive member drum and has an outer diameter of 24 mm. By receiving the driving force of a driving motor (not shown) as drum driving means, the drum is rotated in the direction of arrow A in the drawing.

Further, the charging roller 2 and a cleaning blade 8 as a cleaning member are disposed in the photosensitive member unit 13 so as to come into contact with the circumferential surface of the photosensitive drum 1. The charging roller 2 is urged in a direction toward the photosensitive drum 1 by a spring (not shown), and is driven to rotate as the photosensitive drum 1 rotates.

The cleaning blade 8 slides and rubs the photosensitive drum 1 at a relative speed equal to the surface speed of the photosensitive drum 1 by the rotation of the photosensitive drum 1, scrapes off the toner 10 remaining in the transfer process, and prevents contamination of the charging roller 2 as a charging member by residual toner and the like. Further, discharge products adhering to the surface of the photosensitive drum 1 in the charging step are removed to prevent an increase in friction of the photosensitive drum 1.

The toner scraped off by the cleaning blade 8 is stored in a recovery chamber 9*a*. A configuration may be adopted in which the toner is stored in a toner recovery container provided in the image forming apparatus through the toner recovery chamber 9*a*.

Hereinafter, details of the cleaning blade, the toner, and the photosensitive drum according to the present invention will be described.

Cleaning Blade

Configuration of Cleaning Blade

Figure 3:
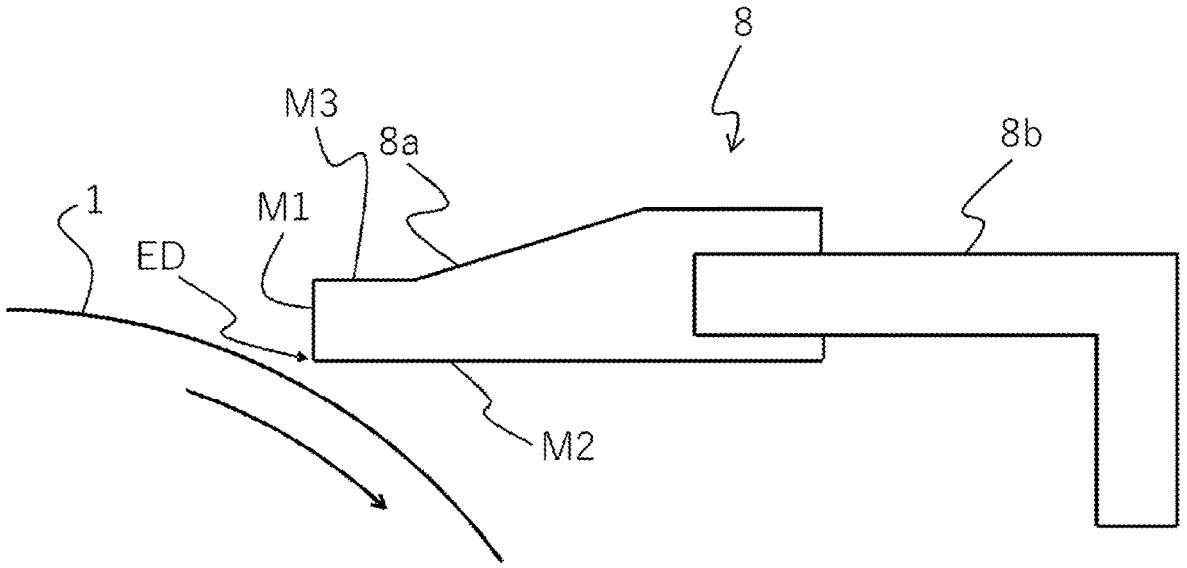
FIG. 3 is a schematic explanatory diagram of a cleaning blade in the embodiment.

FIG. 3 is a schematic cross-sectional view of the cleaning blade 8 of the present embodiment when a cross section perpendicular to the longitudinal direction (rotational axis direction) of the photosensitive drum 1 is viewed along the longitudinal direction.

The cleaning blade 8 of the present embodiment includes an elastic member 8*a* (elastic portion) made of a plate-shaped elastic body and a support member 8*b* (support portion) that supports the elastic member 8*a*. The elastic member 8*a* has a first surface M1 and a second surface M2 that form an edge ED which is a corner portion that is in contact with a portion of the photosensitive drum 1 to be cleaned, and a third surface M3. In the elastic member 8*a*, the surface located upstream in the rotation direction of the photosensitive drum 1 is designated as the first surface M1, the downstream surface is designated as the second surface M2, and the upstream of the first surface M1 is designated as the third surface M3.

That is, the first surface M1 is the distal end surface of the elastic member 8*a*, and is located upstream of the edge ED in the elastic member 8*a* in the rotation direction of the photosensitive drum 1 and faces the circumferential surface of the photosensitive drum 1. Depending on the state of contact of the elastic member 8*a* with the photosensitive drum 1, the region of the first surface M1 on the side adjacent to the edge ED may be in sliding contact with the circumferential surface of the photosensitive drum 1.

The second surface M2 is a side surface that is continuous with the distal end surface of the elastic member 8*a*, with the edge ED being interposed therebetween, and is positioned in the elastic member 8*a* downstream of the edge ED in the rotation direction of the photosensitive drum 1 and faces the circumferential surface of the photosensitive drum 1. Depending on the state of contact of the elastic member 8*a* with the photosensitive drum 1, the region of the second surface M2 on the side adjacent to the edge ED may be in sliding contact with the circumferential surface of the photosensitive drum 1 due to the deflection of the elastic member 8*a* (see FIG. 4C).

The third surface M3 is a side surface that is continuous with the distal end surface of the elastic member 8*a*, that is, the first surface M1, on the side opposite to the second surface M2.

The support member 8*b* is a plate-shaped support member made of a metal sheet metal or the like, and is fixed to the cleaning frame 9. One end of the support member 8*b* is fixed to the cleaning frame 9, and the elastic member 8*a* is fixed to the other end, which is a free end, to constitute the cleaning blade 8. One plate portion of the support member 8*b* bent in an L shape is fixed to the cleaning frame 9 by a fastener such as a screw, and the other plate portion extends in a direction substantially orthogonal to the one plate portion. The elastic member 8*a* is fixed to the distal end of the other plate portion (see FIG. 2). The support member 8*b* (the other plate portion) and the elastic member 8*a* are integrally extended in substantially the same direction from the fixed end (the one plate portion) of the support member 8*b*. The extension direction is a direction (opposite direction) opposite to the rotation direction of the photosensitive drum 1 at a portion of the circumferential surface of the photosensitive drum 1 where the distal end (the other end) of the elastic member 8*a* comes into contact. The direction in which the support member 8*b* and the elastic member 8*a* extend is a direction from the bottom to the top. The rotation direction of the photosensitive drum 1 is a direction in which a portion of the circumferential surface of the photosensitive drum 1 where the distal end (the other end) of the elastic member 8*a* comes into contact moves in a direction from the top to the bottom.

In the posture of the process cartridge 7 in FIG. 2, the process cartridge 7 is mounted on the image forming apparatus main body (during use). In this description, when the positional relationship and direction of each member of the process cartridge are described, the positional relationship and direction in this posture are indicated. That is, the up-down direction in FIG. 2 corresponds to the vertical direction, and the left-right direction corresponds to the horizontal direction. The arrangement configuration is set on the assumption that the image forming apparatus is installed on a horizontal plane in a normal installation state.

In the cleaning blade 8 of the present embodiment, the "free end" of the elastic member 8*a* is the end of the elastic member 8*a* on the side opposite that of the end supported by the support member 8*b*. Further, the "free end portion" of the elastic member 8*a* is the free end and the vicinity thereof. The "edge" is a contact portion of the cleaning blade 8 that is in contact with the member to be cleaned (photosensitive drum 1), and this edge is a ridgeline portion formed in the connection portion of the first surface M1 and the second surface M2 that extend in directions intersecting each other.

The cleaning blade 8 of the present embodiment can be obtained by disposing the support member 8*b* in a die, and then injecting a raw material composition such as polyurethane elastomer or the like into the die, heating, reacting to cure, and then removing from the die. After removal from the die, the distal end portion of the free end of the elastic member 8*a* and both ends in the longitudinal direction of the elastic member 8*a* can be cut as necessary.

The dynamic hardness DHs of the contact portion of the cleaning member in contact with the image bearing member preferably satisfies $0.07\ (mN/\mu m^2) \leq DHs \leq 1.1\ (mN/\mu m^2)$.

Formation of a portion having dynamic hardness DHs such that $0.07\ (mN/\mu m^2) \leq DHs \leq 1.1\ (mN/\mu m^2)$ in the free end portion can be realized by providing a step of hardening the free end portion. The step of forming a hardened region at the tip of the elastic member 8*a* may be performed before or after the cutting. The cleaning blade 8 in which the elastic member 8*a* and the support member 8*b* are integrated can thus be obtained.

Support Member 8*b*

A material constituting the support member 8*b* of the cleaning blade 8 of the present embodiment is not particularly limited, and examples thereof include the following materials. Metal materials such as steel plates, stainless steel plates, galvanized steel plates, and chrome-free steel plates, and resin materials such as 6-nylon and 6,6-nylon. Further, the structure of the support member 8*b* is not particularly limited. One end of the elastic member 8*a* of the cleaning blade 8 is supported by the support member 8*b*.

Elastic Member 8*a*

Examples of the material constituting the elastic member 8*a* of the cleaning blade 8 of the present embodiment include the following materials. A polyurethane elastomer, ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, NBR hydride, polysulfide rubber, etc. As the polyurethane elastomer, a polyester urethane elastomer is preferable because of excellent mechanical properties. The polyurethane elastomer is a material obtained mainly from raw materials such as a polyisocyanate, a polyol, a chain extender, a catalyst, other additives and the like.

Portion for Forming Hardened Region

The portion for forming the hardened region at the distal end of the elastic member 8*a* is at least one surface of the first surface M1 and the second surface M2 that is to be in contact with the member to be cleaned (photosensitive drum 1). Moreover, the internal hardened region close to the surface can also be used.

The hardened region may be also formed on the third surface M3 and both end surfaces in the longitudinal direction of the elastic member 8*a*. In this case, the rigidity of both end surfaces of the elastic member 8*a* can be improved.

Shape of Elastic Member 8*a*

In the elastic member 8*a* of the present embodiment, the angle of the edge formed by the first surface M1 and the second surface M2 is not particularly limited, but is usually at least about 85 degrees and not more than about 95 degrees.

The international rubber hardness (IRHD) of the elastic member 8*a* of the present embodiment is preferably 60 degrees or more, and more preferably 65 degrees or more.

Method for Producing Cleaning Blade

Method of Forming Hardened Region

The method of forming a hardened region at the distal end portion can be performed by applying and curing a material for forming the hardened region. The material for forming the hardened region is used by diluting, as necessary, with a diluting solvent, and can be applied by a well-known means such as dipping, spraying, dispenser, brush coating, roller coating or the like. An isocyanate compound or the like can be used as the material for forming the hardened region. Further, in order for the high-hardness area to be present on the inner side with respect to the surface, it is necessary to sufficiently impregnate the elastic member 8*a* with a material (such as an isocyanate compound) for forming the hardened region. Since the impregnation is promoted by setting the material for forming the hardened region to a high concentration and low viscosity, it is effective to heat, without diluting or the like, the material for forming the hardened region. The material temperature is preferably 60° C. or higher.

Hereinafter, an example of a method for forming a hardened region will be described by using an isocyanate compound as a material for forming the hardened region. The elastic member 8*a* coated with a material for forming a hardened region may be referred to as a "precursor".

Material for Forming Hardened Region

The material for forming a hardened region is not particularly limited as long as the material can harden the elastic member 8*a*, or can form the hardened region on the surface of the elastic member 8*a*, and examples thereof include an isocyanate compound, an acrylic resin, and the like. The material for forming the hardened region may be diluted with a solvent or the like. The solvent used for dilution is not particularly limited as long as the solvent dissolves the material to be used, and examples thereof include toluene, xylene, butyl acetate, methyl isobutyl ketone, methyl ethyl ketone and the like.

In the case where the constituent material of the elastic member 8*a* is a polyester urethane elastomer, it is more preferable that an isocyanate compound which is a constituent material of the polyester urethane elastomer be used as the material for forming the hardened region in consideration of compatibility with the elastic member 8*a* and impregnation into the elastic member 8*a*. A compound having one or more isocyanate groups in the molecule can be used as the isocyanate compound to be brought into contact with the elastic member 8*a*. An aliphatic monoisocyanate such as octadecyl isocyanate (ODI), an aromatic monoisocyanate such as phenyl isocyanate (PHI), and the like can be used as the isocyanate compound having one isocyanate group in the molecule. A compound that is normally used for producing a polyurethane resin can be used as the isocyanate compound having two isocyanate groups in a molecule. Specific examples thereof include 2,4-tolylene diisocyanate (2,4-TDI), 2,6-tolylene diisocyanate (2,6-TDI), 4,4'-diphenylmethane diisocyanate (MDI), m-phenylene diisocyanate (MPDI), tetramethylene diisocyanate (TMDI), hexamethylene diisocyanate (HDI), isophorone diisocyanate (IPDI), and the like. Examples of the isocyanate compound having three or more isocyanate groups in a molecule include 4,4',4"-triphenylmethane triisocyanate, 2,4,4'-biphenyl triisocyanate, 2,4,4'-diphenylmethane triisocyanate, and the like. An isocyanate compound having two or more isocyanate groups can also be used in the form of a modified derivative, a multimer, and the like. Among these compounds, in order to efficiently increase the hardness of the hardened region, MDI having high crystallinity, that is, having a symmetrical structure, is preferable, and MDI including a modified body is liquid at room temperature and is, therefore, more preferable from the viewpoint of workability.

The above-described hardened region is preferably further formed on both surfaces of the first surface M1 and the second surface M2 that form the edge ED of the elastic member 8*a* that comes into contact with the member to be cleaned (photosensitive drum 1). This is because both the first surface M1 and the second surface M2 may be in contact with the photosensitive drum 1 during cleaning.

Method for Measuring Hardness of Cleaning Blade 8

In the present embodiment, the hardness of the hardened region can be measured by the following method. As a measuring device, "Shimadzu Dynamic Ultra Micro Hardness Tester DUH-W211S" manufactured by Shimadzu Corporation can be used. As an indenter, a 115° triangular cone indenter is used, and the dynamic hardness can be obtained from the following calculation formula.

Dynamic hardness: $DHs=\alpha\times P/D^2$

In the formula, a represents a constant depending on the shape of the indenter, P represents the test force (mN), and D represents the amount of penetration of the indenter into the sample (indentation depth) (μm).

The measurement conditions are as follows.

α: 3.8584

P: 1.0 mN

Load speed: 0.03 mN/sec

Holding time: 5 sec

Measurement environment: temperature 23° C., relative humidity 55%

Aging of measurement sample: allowed to stand for 6 h or more in an environment of a temperature of 23° C. and a relative humidity of 55%

Measurement Sample Adjustment Method

A method for preparing the measurement sample is described hereinbelow. The measurement sample is cut out to have dimensions of 4 mm in the longitudinal direction (2 mm in both directions from the middle point) and 2 mm from the edge ED in the lateral direction from each of 3 intermediate points (3 places) at 3 locations obtained by dividing the longitudinal direction into 3 equal portions in the image formation region.

The sample is placed so that the indenter is perpendicular to the hardened surface (first surface M1) of the hardened region of the measurement sample, and the dynamic hardness is measured at a position 2 mm from the end in the longitudinal direction and 100 μm from the edge ED in the lateral direction or the thickness direction. This is because the first surface M1 is mainly in contact at the time of contact and plays a main role of holding the toner.

This measurement is performed on three measurement samples, and the average value is designated as the dynamic hardness DHs of the surface of the cleaning blade 8.

Method for Producing Cleaning Blade 8

Production of Cleaning Blade Precursor

A method for producing the cleaning blade 8 in the present embodiment is not particularly limited as long as a suitable method is selected from known methods. Further, a method for producing the elastic member 8*a* may be suitably selected from well-known methods such as a die molding method and a centrifugal molding method.

For example, in the case of die molding, the support member 8*b* in which an adhesive is applied to a portion to be in contact with the elastic member 8*a* is disposed in a cleaning blade die having a cavity for forming the elastic member 8*a*. Meanwhile, a prepolymer obtained by partial polymerization of polyisocyanate and polyol, and a curing agent including a polyol, a chain extender, a catalyst and other additives are put into a casting machine, and mixed and stirred at a constant ratio in the mixing chamber to obtain a raw material composition such as a polyurethane elastomer. This raw material composition is injected into the die to form a curable molded product (elastic member 8*a*) on the adhesive-coated surface of the support member 8*b*, and is removed from the die after reaction curing. If necessary, the elastic member 8*a* is appropriately cut to ensure a predetermined dimension and the edge size accuracy of the contact portion of the elastic member 8*a*, thereby making it possible to produce a cleaning blade precursor in which the support member 8*b* and the elastic member 8*a* are integrally molded.

When the elastic member 8*a* is produced with a centrifugal molding machine, a raw material composition such as a polyurethane elastomer obtained by mixing and stirring a prepolymer obtained by partial polymerization of polyisocyanate and polyol, and a curing agent including a polyol, a chain extender, a catalyst and other additives is put into a rotating drum to obtain a polyurethane elastomer sheet. This polyurethane elastomer sheet is cut to ensure predetermined dimensions and the edge size accuracy of the contact portion of the elastic member 8*a*. The cleaning blade precursor can be produced by attaching the polyurethane elastomer sheet (elastic member 8*a*) thus obtained to the support member 8*b* coated with an adhesive.

Formation of Hardened Region

The hardened region can be formed by the method described above. That is, first, a material for forming a hardened region is applied to the first surface M1 and the second surface M2 of the distal end portion of the elastic member 8*a* of the cleaning blade precursor. Next, the distal end portion of the elastic member 8*a* is heat-treated, for example, at a temperature of 80° C. or more for 3 min or more. As a result, a hardened region can be formed on the surface and inside the distal end portion of the elastic member 8*a*.

Where it is necessary to cut the elastic member 8*a* in order to form the edge for contacting the member to be cleaned (photosensitive drum 1) on the cleaning blade 8, the hardened region may be formed before or after the cutting. In the case of centrifugal molding, the hardened region can be formed before being joined to the support member 8*b*. The cleaning blade 8 can be obtained as described above.

Examples of manufactured cleaning blades are presented hereinbelow.

In the following description, the numbers 1 to 5 assigned to the cleaning blades are for distinguishing the types thereof, and are different from the reference numeral "8" assigned in other explanations and drawings.

Cleaning Blade 1

In this production example, an integrally molded cleaning blade shown in FIG. 3 was produced and evaluated.

1. Support Member 8*b*

A galvanized steel sheet having a thickness of 1.6 mm was prepared and processed to obtain a support member 8*b* having an L-shaped cross section. An adhesive (trade name: Chemlok 219, manufactured by Lord Corp.) for bonding polyurethane resin was applied to the portion of the support member 8*b* which is to be in contact with the elastic member 8*a*.

2. Preparation of Raw Material for Elastic Member 8*a*

The materials of the kinds and amounts shown in the column of Component 1 in Table 1 were reacted under stirring at 80° C. for 3 h to obtain a prepolymer having an isocyanate molarity of 8.50%. A total of 212.9 g of a curing agent composed of the materials of the kinds and amounts shown in the column of Component 2 in Table 1 was mixed with 1000 g of the prepolymer to prepare a polyurethane elastomer composition having a molar ratio of hydroxyl groups to isocyanate groups (a value) of 0.60, and this composition was used as a raw material for the elastic member 8*a*.

TABLE 1

| | Abbreviation | Material | Amount used (g) |
|---|---|---|---|
| Component 1 | MDI | 4,4'-Diphenylmethane diisocyanate (trade name: Millionate MT, manufactured by Tosoh Corporation) | 321.2 |
| | PBA | Polybutylene adipate polyester polyol having a number average molecular weight of 2500 | 678.8 |
| Component 2 | PHA | Polyhexylene adipate polyester polyol having a number average molecular weight of 1000 | 161.6 |
| | 14BD | 1,4-Butanediol | 28.1 |
| | TMP | Trimethylolpropane | 22.9 |
| | Catalyst A | Polycat 46 (trade name, manufactured by Air Products Japan, Inc.) | 0.07 |
| | Catalyst B | N,N-Dimethylaminohexanol (trade name: Kaolizer No. 25, manufactured by Kao Corp.) | 0.3 |

3. Integrated Molding of Support Member 8*b* and Elastic Member 8*a*

The polyurethane elastomer composition was injected into a molding die for a cleaning blade arranged so that the adhesive application portion of the support member 8*b* protruded into the cavity, followed by curing at 130° C. for 2 min and then removal from the die. Thus, an integrally molded body of the elastic member 8*a* and the support member 8*b* was obtained.

This integrally molded body was cut, as appropriate, before forming the hardened region, to obtain an edge angle of 90 degrees, and the distances in the lateral direction, the thickness direction, and the longitudinal direction of the elastic member 8*a* of 7.5 mm, 1.6 mm, and 237 mm, respectively.

4. Formation of Hardened Region

Modified MDI (trade name; Millionate MTL, manufactured by Tosoh Corporation) was prepared as a material for forming a hardened region. This material for forming a hardened region was heated to 90° C., the elastic member 8*a* of the integrally molded body was immersed for 30 sec in this material so that five surfaces thereof, with the exception of the surfaces on the side facing the support member 8*b*, were immersed, and the material was coated on each surface. Thereafter, the material for forming a hardened region on the surface of the elastic member 8*a* was wiped with a sponge soaked with butyl acetate as a solvent.

In this way, a cleaning blade 1 was obtained in which the hardened region was formed on five surfaces of the elastic member 8*a* (the first surface M1, the second surface M2, the third surface M3, both end surfaces in the longitudinal direction) and on the inside below these surfaces. The hardened region was formed after 24 hours have elapsed since the molding of the elastic member 8*a*.

Cleaning Blade 2

A cleaning blade 2 was formed under the same conditions as the cleaning blade 1 except that the step of forming the hardened region was omitted.

Cleaning Blade 3

A cleaning blade 3 was obtained under the same conditions as the cleaning blade 1 except that in the formation of the hardened region, the temperature of the material for forming the hardened region was changed to 90° C. and the immersion time was changed to 90 sec.

Cleaning Blade 4

A cleaning blade 4 was obtained under the same conditions as the cleaning blade 2 except that in the method for preparing and producing the elastic member raw material, a polyurethane elastomer composition having a molar ratio of hydroxyl groups to an isocyanate group (a value) of 0.90 was prepared and used as the elastic member raw material. Further, the treatment of hardened region formation was not performed.

Cleaning Blade 5

A cleaning blade 5 was obtained under the same conditions as the cleaning blade 1 except that in the formation of the hardened region, the temperature of the material for forming the hardened region was changed to 90° C. and the immersion time was changed to 150 sec.

Table 2 shows the production conditions and dynamic hardness measurement results of the obtained cleaning blades.

TABLE 2

| Item | Number of surfaces coated by immersion | Number of surfaces of elastic member subjected to hardening treatment | Temperature of material for forming hardened region ° C. | Immersion time Second | Time elapsed after molding of elastic member when hardening treatment and formation are performed Unit Hour | Dynamic hardness DHs mN/μm$^2$ |
|---|---|---|---|---|---|---|
| Cleaning blade 1 | 5 surfaces | 5 surfaces | 90 | 30 | 24 | 0.3 |
| Cleaning blade 2 | 0 | 0 | — | — | — | 0.07 |
| Cleaning blade 3 | 5 surfaces | 5 surfaces | 90 | 90 | 24 | 1.1 |
| Cleaning blade 4 | 0 | 0 | — | — | — | 0.05 |
| Cleaning blade 5 | 5 surfaces | 5 surfaces | 90 | 150 | 24 | 1.2 |

Positional Relationship Between Cleaning Blade and Photosensitive Drum

In order to generate a force necessary for cleaning the toner having the below-described Martens hardness of from 200 MPa to 1100 MPa in the cleaning blade 8 having the above features and a slightly deformable distal end, a set angle of from 18° to 26° and a penetration amount of from 0.6 mm to 1.4 mm are suitable.

Where in the cross section perpendicular to the rotation axis of the image bearing member, an angle, between an opposite plane of the cleaning member and a tangent line passing through a virtual point on the peripheral surface of the image bearing member, is designated as a set angle θ, the opposite plane is a place facing the peripheral surface of the image bearing member on a downstream side of an edge of the cleaning member in a rotation direction of the image bearing member when the cleaning member is disposed with respect to the image bearing member so that the edge of the cleaning member is in contact with the virtual point, and a penetration amount of the cleaning member, at the time the cleaning member is moved so as to penetrate with respect to the image bearing member in a direction perpendicular to the tangent line from the virtual point, is denoted by δ, the following conditions are satisfied, $$18 \leq \theta \leq 26(°), \text{ and}$$

$$0.6 \leq \delta \leq 1.4(\text{mm}).$$

The set angle and penetration amount of the cleaning blade 8 are defined as follows.

(1) Set Angle

Figure 4A:
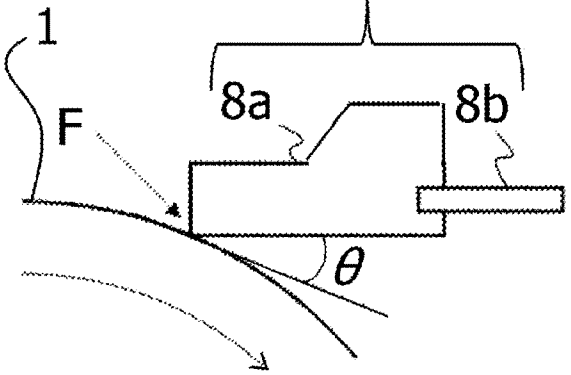
FIGS. 4A to 4C are explanatory diagrams for defining the contact state of the cleaning blade with the photosensitive drum.

An angle θ (FIG. 4A) between the tangent line of the photosensitive drum 1 and the plane (second surface), among the planes sandwiching the edge of the cleaning blade 8, that is on the downstream side in the rotation direction of the photosensitive drum 1 when the cleaning blade 8 is disposed so that the edge of the elastic member 8*a* thereof is in contact with the photosensitive drum 1 at a virtual point F.

(2) Penetration Amount

Figure 4B:
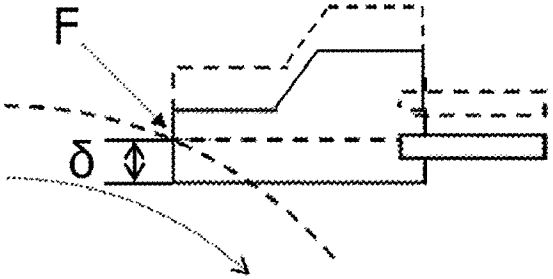

Penetration amount (movement amount) δ when the cleaning blade 8 is caused to penetrate (moved) from the virtual point F in a direction of contact with the photosensitive drum 1 in a direction at 90° to the tangent line (FIG. 4B).

Figure 4C:
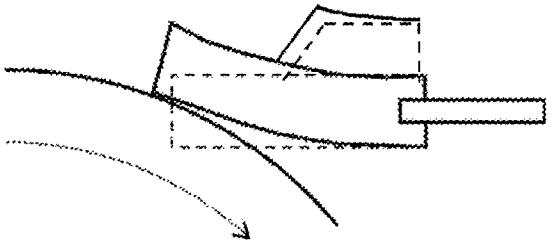

The cleaning blade 8 is fixed so that the edge of the cleaning blade 8 is disposed at the positions (1) and (2) in the absence of the photosensitive drum 1. When fixed and in contact with the photosensitive drum 1, the actual cleaning blade 8 is deformed into the shape such as shown in FIG. 4C.

The developer for developing the latent image formed on the peripheral surface of the image bearing member includes a toner having a toner particle.

Toner

The toner used in Embodiment 1 is, for example, a non-magnetic one-component polymerization toner having a negatively charged polarity, and has a particle diameter of 7 μm.

Method for Producing Toner Particles

As a method for producing toner particles, known means can be used, and a kneading and pulverizing method or a wet production method can be used. From the viewpoint of uniform particle diameter and shape controllability, a wet production method can be preferably used. Furthermore, examples of the wet production method include a suspension polymerization method, a dissolution suspension method, an emulsion polymerization aggregation method, and an emulsion aggregation method.

Here, the suspension polymerization method will be described. In the suspension polymerization method, first, a polymerizable monomer for producing a binder resin and, if necessary, a colorant and other additives are uniformly dissolved or dispersed using a disperser such as a ball mill or an ultrasonic disperser to prepare a polymerizable monomer composition (step of preparing a polymerizable monomer composition). At this time, a polyfunctional monomer, a chain transfer agent, a wax as a release agent, a charge control agent, a plasticizer, and the like can be appropriately added as necessary.

Next, the polymerizable monomer composition is put into an aqueous medium prepared in advance, and droplets made of the polymerizable monomer composition are formed into toner particles of desired size by using a stirrer or a disperser having a high shearing force (granulation step).

It is preferable that the aqueous medium in the granulation step include a dispersion stabilizer in order to control the particle diameter of the toner particles, sharpen the particle size distribution, and suppress coalescence of the toner particles in the production process. Dispersion stabilizers are generally roughly classified into polymers that develop a repulsive force due to steric hindrance and poorly water-soluble inorganic compounds that achieve dispersion stabilization with an electrostatic repulsive force. The fine particles of the poorly water-soluble inorganic compound are preferably used because they are dissolved by an acid or an alkali and, therefore, can be easily dissolved and removed by washing with an acid or an alkali after polymerization.

After the granulation step or while performing the granulation step, the temperature is preferably set to at least 50° C. and not more than 90° C. to polymerize the polymerizable monomer contained in the polymerizable monomer composition, and a toner particle-dispersed solution obtained (polymerization step).

In the polymerization step, it is preferable to perform a stirring operation so that the temperature distribution in the container be uniform. Where a polymerization initiator is added, the addition can be performed at an arbitrary timing and for a required time. In addition, the temperature may be raised in the latter half of the polymerization reaction for the purpose of obtaining a desired molecular weight distribution. Furthermore, in order to remove the unreacted polymerizable monomer and by-products from the system, part of the aqueous medium may be removed by distillation in the latter half of the reaction or after completion of the reaction. The distillation operation can be performed under normal or reduced pressure.

From the viewpoint of obtaining a high-definition and high-resolution image, the toner preferably has a weight average particle diameter of at least 3.0 μm and not more than 10.0 μm. The weight average particle diameter of the toner can be measured by a pore electric resistance method. For example, the measurement can be performed using "Coulter Counter Multisizer 3" (manufactured by Beckman Coulter, Inc.). The toner particle-dispersed solution thus obtained is sent to a filtration step for solid-liquid separation of the toner particles and the aqueous medium.

The solid-liquid separation for obtaining toner particles from the obtained toner particle-dispersed solution can be carried out by a general filtration method. Thereafter, in order to remove foreign matter that could not be removed from the toner particle, it is preferable to perform reslurrying or further washing with running washing water or the like. After sufficient washing, solid-liquid separation is performed again to obtain a toner cake. Thereafter, the toner cake is dried by a known drying means, and if necessary, a particle group having a particle diameter outside the predetermined range is separated by classification to obtain toner particles. The separated particle group having a particle diameter outside the predetermined range may be reused to improve the final yield.

Photosensitive Drum

Figure 5A:
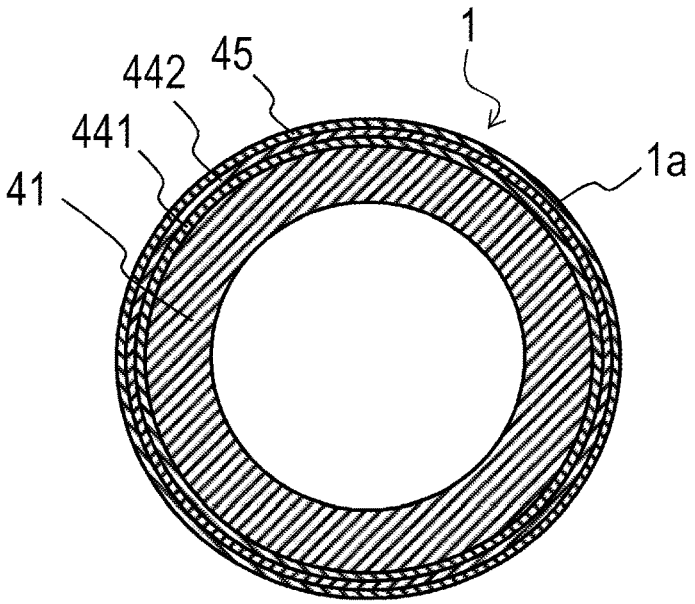
FIGS. 5A and 5B are schematic views showing an example of the form of the photosensitive drum in the embodiment.
Figure 5B:
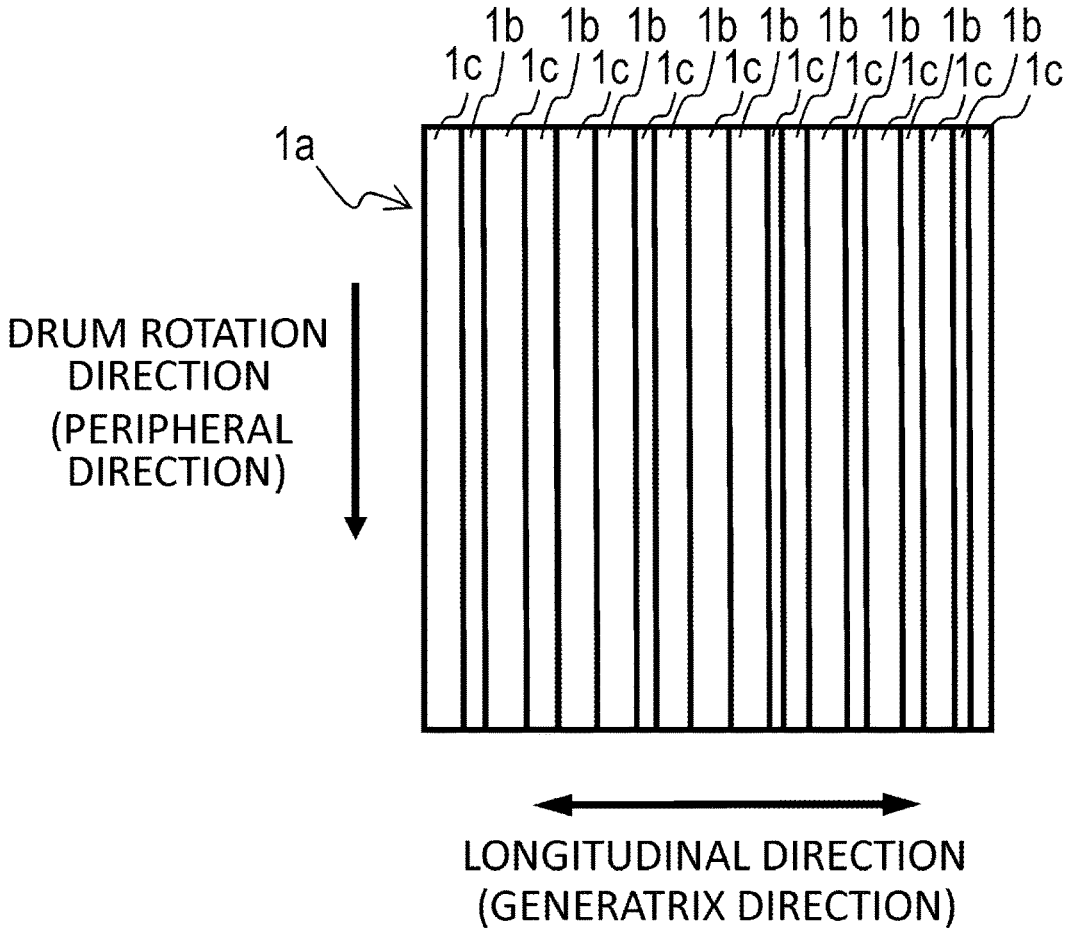

FIGS. 5A and 5B show examples of the layer configuration of the photosensitive drum of the present embodiment.

The photosensitive drum 1 for use in the image forming apparatus 100 according to the present embodiment will be described hereinbelow. The photosensitive drum 1 in this embodiment was produced by the production method described in Japanese Patent No. 4027407. FIG. 5A is a schematic cross-sectional view of the photosensitive drum 1. As shown in FIG. 5A, the photosensitive drum 1 has a support 41, a photosensitive layer (a charge generation layer 441 and a charge transport layer 442) formed on the support 41, and a protective layer 45 formed on the photosensitive layer. Further, the surface 1*a* of the photosensitive drum 1 (protective layer 45) is subjected to roughening treatment by polishing.

Support

The support 41 of the photosensitive drum 1 is preferably a conductive support having electric conductivity. Further, examples of the shape of the support 41 include a cylindrical shape, a belt shape, and a sheet shape. Among these, a cylindrical support is preferable. In the present embodiment, the photosensitive drum 1 is generally configured such that an organic photosensitive layer is provided on a cylindrical support. The surface of the support 41 may be subjected to electrochemical treatment such as anodic oxidation, or to blast treatment, cutting treatment, or the like. As the material for the support, metals, resins, glass and the like are preferable.

Examples of metals include aluminum, iron, nickel, copper, gold, stainless steel, and alloys thereof. Among these, an aluminum support using aluminum is preferable.

Also, the resin or glass may be provided with conductivity by a treatment such as mixing or coating with a conductive material.

Further, a conductive layer may be provided on the support 41. By providing the conductive layer, it is possible to conceal scratches and irregularities on the surface of the support 41 and to control the reflection of light on the surface of the support 41. The conductive layer preferably includes conductive particles and a resin. Examples of the material of the conductive particles include metal oxides, metals, carbon black and the like.

Examples of metal oxides include zinc oxide, aluminum oxide, indium oxide, silicon oxide, zirconium oxide, tin oxide, titanium oxide, magnesium oxide, antimony oxide, and bismuth oxide. Examples of metals include aluminum, nickel, iron, nichrome, copper, zinc, silver and the like. Among these, it is preferable to use a metal oxide as the conductive particles, and it is particularly preferable to use titanium oxide, tin oxide, or zinc oxide.

When a metal oxide is used as the conductive particles, the surface of the metal oxide may be treated with a silane coupling agent or the like, or the metal oxide may be doped with an element such as phosphorus or aluminum or an oxide thereof.

In addition, the conductive particle may have a multilayer structure including a core particle and a coating layer that covers the particle. Examples of the core particles include titanium oxide, barium sulfate, zinc oxide and the like. Examples of the coating layer include metal oxides such as tin oxide and the like.

Further, when a metal oxide is used as the conductive particles, the volume average particle diameter is preferably at least 1 nm and not more than 500 nm, and more preferably at least 3 nm and not more than 400 nm.

Examples of the resin include polyester resin, polycarbonate resin, polyvinyl acetal resin, acrylic resin, silicone resin, epoxy resin, melamine resin, polyurethane resin, phenol resin, alkyd resin, and the like.

The conductive layer may further include a masking agent such as silicone oil, resin particles, titanium oxide and the like.

The average film thickness of the conductive layer is preferably at least 1 μm and not more than 50 μm, and particularly preferably at least 3 μm and not more than 40 μm.

The conductive layer can be formed by preparing a coating liquid for a conductive layer including the above-mentioned materials and a solvent, forming the coating film, and drying. Examples of the solvent used for the coating liquid include alcohol solvents, sulfoxide solvents, ketone solvents, ether solvents, ester solvents, aromatic hydrocarbon solvents and the like. Examples of the dispersion method for dispersing the conductive particles in the coating liquid for the conductive layer include methods using a paint shaker, a sand mill, a ball mill, and a liquid collision type high-speed disperser.

Undercoat Layer

An undercoat layer is provided on the support or conductive layer. By providing the undercoat layer, the adhesion function (fixing function) between the layers can be enhanced, and a charge injection blocking function can be provided.

The undercoat layer preferably includes a resin. Further, the undercoat layer may be formed as a cured film by polymerizing a composition including a monomer having a polymerizable functional group.

The resin can be exemplified by polyester resin, polycarbonate resin, polyvinyl acetal resin, acrylic resin, epoxy resin, melamine resin, polyurethane resin, phenol resin, polyvinyl phenol resin, alkyd resin, polyvinyl alcohol resin, polyethylene oxide resin, polypropylene oxide resin, polyamide resin, polyamic acid resin, polyimide resin, polyamideimide resin, cellulose resin and the like.

The polymerizable functional group of the monomer having a polymerizable functional group can be exemplified by an isocyanate group, a blocked isocyanate group, a methylol group, an alkylated methylol group, an epoxy group, a metal alkoxide group, a hydroxyl group, an amino group, a carboxyl group, a thiol group, a carboxylic anhydride group, a carbon-carbon double bond group and the like.

In addition, the undercoat layer may further include an electron transport material, a metal oxide, a metal, a conductive polymer, and the like for the purpose of improving electrical characteristics. Among these, it is preferable to use an electron transport material and a metal oxide.

Examples of the electron transport material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, boron-containing compounds and the like. The undercoat layer may be formed as a cured film by using an electron transport material having a polymerizable functional group as the electron transport material and copolymerizing with the monomer having the polymerizable functional group described above.

Examples of the metal oxide include indium tin oxide, tin oxide, indium oxide, titanium oxide, zinc oxide, aluminum oxide, silicon dioxide and the like. Examples of the metal include gold, silver, aluminum and the like.

The undercoat layer may further include an additive.

The average thickness of the undercoat layer is preferably at least 0.1 μm and not more than 50 μm, more preferably at least 0.2 μm and not more than 40 μm, and particularly preferably at least 0.3 μm and not more than 30 μm.

The undercoat layer can be formed by preparing a coating liquid for the undercoat layer including the above-mentioned materials and a solvent, forming the coating film thereof, and drying and/or curing. Examples of the solvent used for the coating solution include alcohol solvents, ketone solvents, ether solvents, ester solvents, aromatic hydrocarbon solvents and the like.

Charge Generation Layer

The charge generation layer 441 preferably includes a charge generation material and a resin. Examples of the charge generation material include azo pigments, perylene pigments, polycyclic quinone pigments, indigo pigments, phthalocyanine pigments and the like. Among these, azo pigments and phthalocyanine pigments are preferable. Among the phthalocyanine pigments, an oxytitanium phthalocyanine pigment, a chlorogallium phthalocyanine pigment, and a hydroxygallium phthalocyanine pigment are preferable.

The amount of the charge generation material in the charge generation layer 441 is preferably at least 40% by mass and not more than 85% by mass, and more preferably at least 60% by mass and not more than 80% by mass with respect to the total mass of the charge generation layer.

The resins can be exemplified by polyester resin, polycarbonate resin, polyvinyl acetal resin, polyvinyl butyral resin, acrylic resin, silicone resin, epoxy resin, melamine resin, polyurethane resin, phenol resin, polyvinyl alcohol resin, cellulose resin, polystyrene resin, polyvinyl acetate resin, polyvinyl chloride resin and the like. Among these, polyvinyl butyral resin is more preferable.

The charge generation layer 441 may further include an additive such as an antioxidant, an ultraviolet absorber and the like. Specific examples include hindered phenol compounds, hindered amine compounds, sulfur compounds, phosphorus compounds, benzophenone compounds and the like.

The average film thickness of the charge generation layer 441 is preferably at least 0.1 μm and not more than 1 μm, and more preferably at least 0.15 μm and not more than 0.4 μm.

The charge generation layer 441 can be formed by preparing a coating liquid for a charge generation layer including the above-mentioned materials and a solvent, forming a coating film thereof, and drying. Examples of the solvent used for the coating liquid include alcohol solvents, sulfoxide solvents, ketone solvents, ether solvents, ester solvents, aromatic hydrocarbon solvents and the like.

Charge Transport Layer

The charge transport layer 442 preferably includes a charge transport material and a resin. Examples of the charge transport material include polycyclic aromatic compounds, heterocyclic compounds, hydrazone compounds, styryl compounds, enamine compounds, benzidine compounds, triarylamine compounds, resins having groups derived from these materials, and the like. Among these, triarylamine compounds and benzidine compounds are preferable.

The amount of the charge transport material in the charge transport layer 442 is preferably at least 25% by mass and not more than 70% by mass, and more preferably at least 30% by mass and not more than 55% by mass with respect to the total mass of the charge transport layer 442.

Examples of the resin include polyester resin, polycarbonate resin, acrylic resin, polystyrene resin and the like. Among these, polycarbonate resin and polyester resin are preferable. As the polyester resin, polyarylate resin is particularly preferable.

The content ratio (mass ratio) between the charge transport material and the resin is preferably 4:10 to 20:10, and more preferably 5:10 to 12:10.

The charge transport layer 442 may also include an additive such as an antioxidant, an ultraviolet absorber, a plasticizer, a leveling agent, a slipperiness imparting agent, and an abrasion resistance improving agent. Specific examples include hindered phenol compounds, hindered amine compounds, sulfur compounds, phosphorus compounds, benzophenone compounds, siloxane-modified resins, silicone oil, fluorine resin particles, polystyrene resin particles, polyethylene resin particles, silica particles, alumina particles, boron nitride particles and the like.

The average film thickness of the charge transport layer 442 is preferably at least 5 μm and not more than 50 μm, more preferably at least 8 μm and not more than 40 μm, and particularly preferably at least 10 μm and not more than 30 μm. In Embodiment 1, the thickness was 12 μm.

The charge transport layer 442 can be formed by preparing a coating liquid for a charge transport layer including the above-mentioned materials and a solvent, forming a coating film thereof, and drying. Examples of the solvent used for the coating liquid include alcohol solvents, ketone solvents, ether solvents, ester solvents, aromatic hydrocarbon solvents and the like. Among these solvents, ether solvents or aromatic hydrocarbon solvents are preferable.

Protective Layer

The photosensitive drum 1 is provided with a wear-resistant protective layer 45 on the outermost layer in order to improve wear resistance. By providing the protective layer 45, durability can be improved.

The protective layer 45 preferably includes conductive particles and/or a charge transport material and a resin.

Examples of the conductive particles include metal oxide particles such as titanium oxide, zinc oxide, tin oxide, indium oxide and the like.

Examples of the charge transport material include polycyclic aromatic compounds, heterocyclic compounds, hydrazone compounds, styryl compounds, enamine compounds, benzidine compounds, triarylamine compounds, resins having groups derived from these substances and the like. Among these, triarylamine compounds and benzidine compounds are preferable.

Examples of the resin include polyester resin, acrylic resin, phenoxy resin, polycarbonate resin, polystyrene resin, phenol resin, melamine resin, epoxy resin and the like. Among these, polycarbonate resin, polyester resin, and acrylic resin are preferable.

Further, the protective layer 45 may be formed as a cured film by polymerizing a composition including a monomer having a polymerizable functional group. Examples of the reaction at that time include a thermal polymerization reaction, a photopolymerization reaction, a radiation polymerization reaction and the like. Examples of the polymerizable functional group of the monomer having a polymerizable functional group include an acryl group, a methacryl group and the like. As the monomer having a polymerizable functional group, a material having a charge transport ability may be used.

The protective layer 45 may include an additive such as an antioxidant, an ultraviolet absorber, a plasticizer, a leveling agent, a slipperiness imparting agent, and an abrasion resistance improving aunt. Specific examples include hindered phenol compounds, hindered amine compounds, sulfur compounds, phosphorus compounds, benzophenone compounds, siloxane-modified resins, silicone oil, fluorine resin particles, polystyrene resin particles, polyethylene resin particles, silica particles, alumina particles, boron nitride particles and the like.

The average film thickness of the protective layer 45 is preferably at least 0.5 μm and not more than 10 μm, and more preferably at least 1 μm and not more than 7 μm.

The protective layer 45 can be formed by preparing a coating liquid for a protective layer including the above-described materials and a solvent, forming a coating film thereof, and drying and/or curing. Examples of the solvent used for the coating liquid include alcohol solvents, ketone solvents, ether solvents, sulfoxide solvents, ester solvents, aromatic hydrocarbon solvents and the like.

In the present embodiment, the average film thickness of the protective layer 45 is 3 μm.

Roughening Treatment

The photosensitive drum 1 of the present embodiment is subjected to roughening treatment for polishing the surface of the photosensitive drum 1 in order to reduce the contact surface area with the cleaning blade 8 and reduce the driving torque of the photosensitive drum 1.

According to Japanese Patent No. 4027407, a plurality of grooves are arranged in the longitudinal direction (generatrix direction) on the peripheral surface of the photosensitive drum 1 so that the width of the grooves extending in a substantially circumferential direction of the peripheral surface is in the range of at least 0.5 μm and not more than 40 μm.

FIG. 5B shows an example of the state of the grooves 1*b* formed on the peripheral surface 1*a* of the photosensitive drum 1. As shown in FIG. 5B, the grooves 1*b* are annular grooves extending in the circumferential direction on the peripheral surface 1*a* of the photosensitive drum 1, and are formed to be arranged side by side at intervals in the generatrix direction of the peripheral surface 1*a*. That is, the peripheral surface 1*a* has a configuration in which flat portions 1*c* in which the grooves 1*b* are not formed and the grooves 1*b* are alternately formed in the generatrix direction. The region where the grooves 1*b* are to be formed on the peripheral surface 1*a* only needs to include at least the region to be in contact with the cleaning blade 8, and it is not necessary to form the grooves over the entire region in the longitudinal direction of the peripheral surface 1*a*.

As described in the abovementioned open publication, the configuration in which the grooves 1*b* are formed to extend in the same direction as the circumferential direction as shown in FIG. 6B is not limiting. For example, the grooves 1*b* may be formed to have an angle of 10° with respect to the circumferential direction. Further, the grooves 1*b* may be formed to have an angle of ±30° with respect to the circumferential direction, and the grooves 1*b* having different angles may be configured to intersect each other. In the present embodiment, the "substantially circumferential direction" is inclusive of a completely circumferential direction and an almost circumferential direction, and the almost circumferential direction is specifically less than ±60° with respect to the circumferential direction.

The number of the grooves 1*b* is preferably at least 20 and not more than 1000 per a width of 1000 μm in the generatrix direction of the peripheral surface 1*a* (hereinafter, the number of the grooves 1*b* having a width in the range of 0.5 μm to 40 μm per a width of 1000 μm in the generatrix direction of the peripheral surface 1*a* is also referred to as "groove density"; in other words, in the above case, the groove density is 20 to 1000).

When the number of the grooves 1*b* per a width of 1000 μm in the generatrix direction of the peripheral surface 1*a* is defined as the "groove density", where the groove density is smaller than 20, the edge portion of the cleaning blade is likely to be chipped due to an increase in the number of sheets that are passed. As a result, cleaning defects tend to occur, and a black streak-shaped image is likely to appear on the output image. Further, toner or the like is likely to be fused, and a white dot-shaped image is likely to appear on the output image.

Meanwhile, when the groove density exceeds 1000, the character reproducibility deteriorates, a small character (for example, a character of 3 points or less) image is unlikely to be reproduced and will fade, or a cleaning defect, such as slipping of the toner through the cleaning blade, can occur, in particular, in a low-humidity environment.

Further, the grooves 1*b* having a width exceeding 40 μm tend to cause uneven shading and a white scratch image on a halftone image, and also tend to cause a black scratch image on a white background image. Therefore, the ratio of the number of grooves 1*b* having a width exceeding 40 μm among the grooves 1*b* formed on the peripheral surface 1*a* of the photosensitive drum 1 is preferably 20% by number or less with respect to all the grooves 1*b* formed on the peripheral surface of the photosensitive drum 1.

Further, the ten-point average surface roughness Rz of the peripheral surface 1*a* of the photosensitive drum 1 is preferably 0.3 μm to 1.3 μm. This is so because where the roughness is smaller than 0.3 μm, the effect of eliminating the image blur may be diminished, and where the roughness exceeds 1.3 μm, a small character (for example, a character of 3 points or less) image is unlikely to be reproduced and will fade.

Based on the above, the same roughening treatment as described in Japanese Patent No. 4027407 was performed in the present embodiment, but the conditions were as follows.

Figure 6:
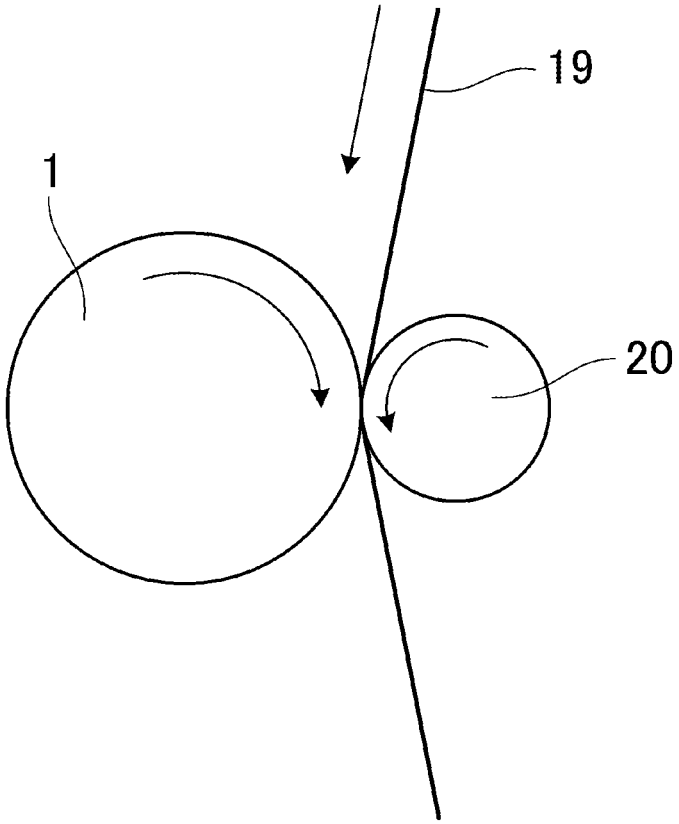
FIG. 6 is a schematic view of a polishing apparatus for polishing the surface of the photosensitive drum in the embodiment.

FIG. 6 is a schematic view of a polishing apparatus for polishing the surface 1*a* of the photosensitive drum 1. In the present embodiment, the surface 1*a* of the photosensitive drum 1 was polished using the polishing apparatus shown in FIG. 6, and the roughening treatment was performed as shown in FIG. 5B.

A polishing sheet 19 is wound in the direction of the arrow by a winding mechanism (not shown). The photosensitive drum 1 rotates in the direction of the arrow. A backup roller 20 rotates in the direction of the arrow. As polishing conditions, a polishing sheet manufactured by Riken Corundum Co., Ltd. (trade name: GC #3000, base sheet thickness: 75 μm) was used as the polishing sheet 19, a urethane roller (outer diameter: 50 mm) having a hardness of 20° was used as the backup roller 20, the penetration amount was 2.5 mm, the sheet feed amount was 200 mm/s to 400 mm/s, the polishing sheet feed direction and the photosensitive drum 1 rotation direction were the same, and polishing was performed for 5 sec to 30 sec.

A plurality of grooves extending in the circumferential direction of the peripheral surface and having a width in the generatrix direction of the peripheral surface in the range of at least 0.5 μm and not more than 40 μm was formed side by side in the generatrix direction on the peripheral surface of the photosensitive drum subjected to the roughening treatment.

Further, the number of grooves was at least 20 and not more than 1000 (specifically, 400 grooves) per a width of 1000 μm in the generatrix direction of the peripheral surface.

As for the surface roughness of the photosensitive drum 1 after polishing, the average height (Rpk) of ridges of projections above the core section of the roughness curve of the peripheral surface of the image bearing member, the height (Rk) of the core portion forming the center of the roughness curve of the peripheral surface of the image bearing member, and the average depth (Rvk) of valleys (a valley) of the projections (a projection) under the core section of the roughness curve of the peripheral surface of the image bearing member were measured under the following conditions according to KS B 0671-2 using a surface roughness measuring device (trade name: SE700, SMB-9, manufactured by Kosaka Kenkyusho Ltd.).

The measurement was performed at positions 30, 110, and 185 mm from the upper end of the coating in the longitudinal direction of the photosensitive drum 1, the drum was then rotated 120° forward, and the measurement was similarly performed at the positions 30, 110, and 185 mm from the upper end of the coating. Further, after rotating 120° forward, the measurement was performed in the same manner, the measurement was thus performed at a total of 9 points, and each photosensitive drum of (Table 3) was produced as the photosensitive drum 1. In the following description, the numbers 1 to 4 assigned to the photosensitive drums are, similarly to the cleaning blades 1 to 5, for distinguishing the types thereof and are different from the reference numeral "1" assigned in other explanations and drawings. The measurement conditions were as follows: measurement length: 2.5 mm, cut-off value: 0.8 mm, feed rate: 0.1 minis, filter characteristic: 2CR, leveling: straight line (whole area).

The average depth (Rvk) of the valleys of the projections under the core section of the roughness curve of the peripheral surface of the image bearing member is preferably at least 0.01 μm and not more than 0.08 μm, and more preferably at least 0.01 μm and not more than 0.03 μm.

The average height (Rpk) of the ridges of the projections above the core section of the roughness curve of the peripheral surface of the image bearing member is preferably at least 0.01 μm and not more than 0.02 μm, and more preferably at least 0.01 μm and not more than 0.015 μm.

The sum of the average height (Rpk) of the ridges of the projections above the core section of the roughness curve of the peripheral surface of the image bearing member, the height (Rk) of the core portion forming the center of the roughness curve of the peripheral surface of the image bearing member, and the average depth (Rvk) of the valleys of the projections under the core section of the roughness curve of the peripheral surface of the image bearing member is preferably at least 0.03 μm and not more than 0.24 μm, and more preferably at least 0.03 μm and not more than 0.10 μm.

This is because where the sum of the average height (Rpk) of the ridges of the projections above the core section of the roughness curve of the peripheral surface of the photosensitive drum, the height (Rk) of the core portion forming the center of the roughness curve of the peripheral surface, and the average depth (Rvk) of the valleys of the projections under the core section of the roughness curve of the peripheral surface becomes larger than 0.24 μm, even if the average depth (Rvk) of the valleys of the projections under the core section of the roughness curve is reduced, the gap between the cleaning blade and the photosensitive drum becomes larger than the toner particle diameter, and the toner slip-through occurs.

TABLE 3

| | Rpk [μm] | Rk [μm] | Rvk [μm] | Rpk + Rk + Rvk [μm] |
|---|---|---|---|---|
| Photosensitive drum 1 | 0.02 | 0.10 | 0.08 | 0.20 |
| Photosensitive drum 2 | 0.04 | 0.08 | 0.08 | 0.20 |
| Photosensitive drum 3 | 0.02 | 0.08 | 0.1 | 0.20 |
| Photosensitive drum 4 | 0.06 | 0.10 | 0.09 | 0.25 |

EXAMPLES

In Examples 1 to 6 of Embodiment 1 and Comparative Examples 1 and 2, combinations of cleaning blades 1 to 5 and photosensitive drums 1 to 4 such as shown in Table 4 were prepared.

Tests

Torque

The developer storage chamber 18*b* of the process cartridge 7 was filled with 100 g of the toner. Similarly, the cleaning blades and photosensitive drums of Examples 1 to 6 and Comparative Examples 1 and 2 were attached to the photosensitive member unit 13, the set angle θ of the cleaning blades was set to 22°, and the penetration amount δ was set to 1.0 mm.

In a state of contact with the developing roller at a room temperature of 15° C. and a relative humidity of 10% Rh, a voltage of −1 kV was applied to the charging roller, the developing roller was grounded, and a voltage of −100 kV was applied to the supply roller and the regulating member, while rotating at a photosensitive member surface speed of 296 mm/s and a developing roller surface speed of 425 mm/s.

The photosensitive member driving torque within 2 sec after 30 sec from the start of rotation was measured. Evaluation was performed as follows.

A: good low torque property (0.16 N·m or less)

B: has a low torque effect (more than 0.16 N·m and equal to or less than 0.18N·m)

C: has a low torque effect (more than 0.18 N·m and equal to or less than 0.20 N·m)

F: low torque effect is not observed (more than 0.20N·m)

Combinations with evaluations A, B and C were considered to have a torque reduction effect. The results are shown in the "Torque" column of Table 4.

Toner Slip-Through

The image forming apparatus 100 was used to form 15,000 prints of images with a print percentage of 1% in an environment with a room temperature of 15° C. and a relative humidity of 10% Rh. An intermittent time of 3 sec was provided for every two images formed.

The photosensitive drum surface speed was 296 mm/s, the developing roller surface speed was 425 mm/s, the photosensitive drum surface potential was −500 V, the voltage applied to the developing roller was −350 V, the supply roller voltage was −450 V, and the regulating member voltage was −450 V.

The toner slip-through after the formation of 15,000 images was evaluated. Evaluation was performed as follows.

A: there is no visible dirt on the photosensitive member surface and no effect on the image B: there is almost no visible dirt on the photosensitive member surface and no effect on the image C: minor toner slip-trough is seen on the photosensitive member surface, but no effect on the image F: dirt is seen on the photosensitive member surface and there is also effect on the image The effect on the image is considered to be an occurrence of streaks due to the toner slip-through in the recording material conveyance direction on a white image.

The results are shown in the "Toner slip-through" column in Table 4. Combinations with A, B and C having no effect on the image were regarded as demonstrating the effect of the invention.

TABLE 4

| | Photo-sensitive drum No. | Cleaning blade No. | Torque | Toner slip-through |
|---|---|---|---|---|
| Example 1 | 1 | 1 | A | A |
| Example 2 | 1 | 2 | A | B |
| Example 3 | 1 | 3 | B | A |
| Example 4 | 1 | 4 | A | C |
| Example 5 | 1 | 5 | C | A |
| Example 6 | 2 | 1 | C | A |
| Comparative Example 1 | 3 | 1 | A | F |
| Comparative Example 2 | 4 | 1 | F | F |

As described above, in a preferable example, the average height (Rpk) of the ridges of the projections above the core section of the roughness curve of the peripheral surface of the photosensitive drum is set to 0.02 μm or less, the average depth (Rvk) of the valleys of the projections under the core section of the roughness curve of the peripheral surface is set to 0.08 μm or less, and the dynamic hardness DHs of the cleaning blade is set at least 0.07 and not more than 1.1.

In addition, by setting the set angle in the contact state of the cleaning blade with the photosensitive drum to 18° to 26°, and setting the penetration amount to 0.6 mm to 1.4 mm, it is also possible to further suppress the toner slip-through while realizing a low torque.

This is because, for example, where the average height (Rpk) of the ridges of the projections above the core section of the roughness curve of the peripheral surface of the photosensitive drum is set to 0.02 μm or less, the surface area of the contact portion of the cleaning blade and the photosensitive drum is reduced and the torque lowering effect can be easily obtained. Further, for example, where the average depth (Rvk) of the valleys of the projections under the core section of the roughness curve of the peripheral surface is set to 0.08 μm or less, a gap larger than the toner particle diameter is unlikely to be formed between the cleaning blade and the drum. Further, by setting the dynamic hardness DHs of the cleaning blade to 0.07 to 1.1 in this state, a sufficient pressure can be applied between the cleaning blade and the photosensitive drum, and the slip-through can be further suppressed.

In Example 4, since the dynamic hardness DHs of the cleaning blade was low, the surface pressure was likely to decrease, and certain toner slip-through occurred.

In Example 5, since the dynamic hardness DHs of the cleaning blade was high, the surface pressure increased and the torque reduction effect was somewhat reduced.

In Example 6, the average height (Rpk) of the ridges of the projections above the core section of the roughness curve of the peripheral surface of the photosensitive drum was large, the contact surface area between the cleaning blade and the photosensitive drum was not sufficiently narrow, and torque reduction effect was somewhat reduced.

In Comparative Example 1, the average depth (Rvk) of the valleys of the projections under the core section of the roughness curve of the peripheral surface of the photosensitive drum was large, a gap was generated between the cleaning blade and the photosensitive drum, and the toner slip-through occurred.

In Comparative Example 2, the average height (Rpk) of the ridges of the projections above the core section of the roughness curve of the peripheral surface of the photosensitive drum was large, the contact surface area between the cleaning blade and the photosensitive drum was not sufficiently narrow, and the torque could not be lowered sufficiently. Further, since (Rpk+Rk+Rvk) was as large as 0.25, a large gap was generated between the cleaning blade and the photosensitive drum, and the toner slip-through occurred.

Posture Range of Cleaning Blade in which Low Torque and Toner Slip-Through Prevention can be Achieved For the configuration of Example 1, he torque was measured by variously changing the set angle θ, the penetration amount δ, and the evaluation conditions (room temperature 15° C., relative humidity 10% Rh [hereinafter also referred to as L/L], or room temperature 30° C., relative humidity 80% Rh [hereinafter also referred to as H/H]) as shown in Tables 5 and 6. The results are shown in Tables 5 and 6. The evaluation in Table 5 used the above (torque) evaluation criteria.

Where the set angle is 18° to 26° (18≤θ≤26(°)) and the penetration amount is 0.6 mm to 1.4 mm (0.6≤δ≤1.4 (mm)), the torque is 0.20 N·m or less.

Images were also formed at a print percentage of 1% on 15,000 prints in the [L/L] and [H/H] environments. The results are shown in Tables 5 and 6. The evaluation used the abovementioned evaluation criteria of (Relationship between low torque, toner slip-through, photosensitive drum surface roughness, and cleaning blade).

Since the contact force at the contact portion increased and the cleaning property improved as the penetration amount was increased, it was found that the cleaning can be suitably performed in the range of 0.6 mm to 1.4 mm and the set angle of 18° to 26°.

It follows from the above that in order to maintain the torque reduction effect while adequately cleaning by applying a sufficient pressure, 18° to 26° and 0.6 mm to 1.4 mm are preferable, and 20° to 24° and 0.9 mm to 1.2 mm are more preferable.

In a region where the penetration amount is less than 0.6 mm or the set angle is less than 18°, the followability of the cleaning blade tended to become low in an environment of a room temperature of 10° C. and a relative humidity of 15% Rh, and he toner was likely to slip through in a belt-like manner due to eccentricity of the photosensitive drum and minute irregularities on the edge of the blade.

Meanwhile, in the range in which the penetration amount was 1.5 mm or more or the set angle exceeded 26°, the cleaning blade tended to be turned up in an environment of a room temperature of 30° C. and a relative humidity of 80% Rh.

TABLE 5

Relationship between cleaning blade posture and photosensitive member driving torque

| | | Set angle (°) | | | | | | |
|---|---|---|---|---|---|---|---|---|
| | | 16 | 18 | 20 | 22 | 24 | 26 | 28 |
| Penetration amount (mm) | 0.5 | (10° C./15% Rh) | | | (10° C./15% Rh) | | | |
| | 0.6 | | | A | | | | (30° C./80% Rh) |
| | 0.7 | | | | | A | | |
| | 0.8 | | | | | | | |
| | 0.9 | | B | A | | A | B | |
| | 1 | | | | A | | | |
| | 1.1 | | | | | | | |
| | 1.2 | | | A | A | B | | |
| | 1.3 | | | | | | | |
| | 1.4 | | | | B | | | |
| | 1.5 | | | (30° C./80% Rh) | | | | |

(unit: N · m)

TABLE 6

Relationship between cleaning blade posture and durability changing member contamination

| | | Set angle (°) | | | | | | |
|---|---|---|---|---|---|---|---|---|
| | | 16 | 18 | 20 | 22 | 24 | 26 | 28 |
| Penetration amount (mm) | 0.5 | (10° C./15% Rh) | | | (10° C./15% Rh) | | | |
| | 0.6 | | | B | | | | (30° C./80% Rh) |
| | 0.7 | | | | | B | | |
| | 0.8 | | | | | | | |
| | 0.9 | | B | A | | B | B | |
| | 1 | | | | A | | | |
| | 1.1 | | | | | | | |
| | 1.2 | | | B | | A | | |
| | 1.3 | | | | | | | |
| | 1.4 | | | | A | | | |
| | 1.5 | | | (30° C./80% Rh) | | | | |

As described above, according to the present embodiment, in a state in which the contact surface area of the cleaning blade and the photosensitive drum is suppressed it is possible to suppress the gap between the cleaning blade and the photosensitive drum to a range in which the toner slip-through can be suppressed. Further, by setting the dynamic hardness DHs of the cleaning blade to 0.07 to 1.1, it is possible to secure a sufficient surface pressure. As a result, it is possible to provide a process cartridge in which the driving torque of the photosensitive drum is low and no streak image is generated due to toner slip-through.

Embodiment 2

In the Embodiment 1, the variables relating to the roughness curve of the peripheral surface of the image bearing member, the dynamic hardness DHs of the contact portion of the cleaning member in contact with the image bearing member, the set angle θ and the penetration amount δ relating to the cleaning member, and the reduction of the driving torque of the photosensitive drum, and suppression of toner slip-through from the cleaning blade were studied.

Meanwhile, in Embodiment 2, the above effects can be obtained over a longer life by controlling the specific hardness of the toner in addition to the abovementioned parameters.

In the description of the present embodiment, the description of the same parts as those of the Embodiment 1 is omitted.

In Embodiment 2, the developer includes a toner having a toner particle, the toner particle has a surface layer including an organosilicon polymer having a structure represented by a following formula (1):

the fixing ratio of the organosilicon polymer on the surface of the toner particle is 90% or more, the toner preferably has a Martens hardness of at least 200 MPa and not more than 1100 MPa when measured under a maximum load of $2.0\times10^{-4}$ N.

$$R—SiO_{3/2} \qquad \text{Formula (1)}$$

(R is a hydrocarbon group having at least 1 and not more than 6 carbon atoms.)

In order to obtain the Martens hardness of the toner of at least 200 MPa and not more than 1100 MPa when measured under a maximum load of $2.0\times10^{-4}$N, for example, a toner particle can be used that has a surface layer including a specific organosilicon polymer.

Further, a method of forming a surface layer including an organosilicon polymer on the surface of the toner particle is suitable for obtaining the fixing ratio of the organosilicon polymer on the surface of the toner particle of 90% or more. This will be described herein below in greater detail.

Method for Measuring Martens Hardness of Toner

Hardness is one of the mechanical properties at or near the surface of an object and represents resistance of the object to deformation and scratching when the object is about to be deformed or scratched by foreign matter. Various measurement methods and definitions are known for hardness. For example, the appropriate measurement method is used according to the size of the measurement region. When the measurement region is 10 μm or more, a Vickers method is often used, when the measurement region is 10 μm or less, a nanoindentation method is used, and when the measurement region is 1 μm or less, an AFM or the like is used. Regarding the definitions, Brinell hardness and Vickers hardness are used as indentation hardness, Martens hardness is used as scratch hardness, and Shore hardness is used as rebound hardness.

In the measurement of toner, since the general particle diameter is from 3 μm to 10 μm, the nanoindentation method is preferably used. According to the study conducted by the inventors, Martens hardness representing scratch hardness is appropriate to specify hardness for enhancing the effect of the present invention. This is thought to be so because the scratch hardness represents the resistance of the toner to scratching by a hard substance such as a metal or an external additive in the developing machine.

With the method for measuring the Martens hardness of the toner by the nanoindentation method, the hardness can be calculated from a load-displacement curve obtained in accordance with the procedure of the indentation test stipulated by ISO14577-1 in a commercially available apparatus conforming to ISO14577-1. In the present invention, an ultra-fine indentation hardness tester "ENT-1100b" (manufactured by Elionix Inc.) was used as an apparatus conforming to the ISO standard. The measurement method is described in the "ENT1100 Operation Manual" provided with the apparatus. The specific measurement method is as follows.

The measurement environment was maintained at 30.0° C. inside a shield case with a provided temperature control device. Keeping the ambient temperature constant is effective in terms of reducing variations in measurement data due to thermal expansion and drift. The set temperature was 30.0° C., assuming a temperature in the vicinity of the developing machine where the toner was rubbed. The sample stage used was a standard sample stage provided with the apparatus. After applying the toner, weak air flow was blown so that the toner was dispersed, and the sample stage was set on the apparatus and held for 1 h or more, and then the measurement was performed.

The measurement was performed using a flat indenter (titanium indenter, tip is made of diamond) having a planar 20 μm square tip and provided with the apparatus. A flat indenter was used because where a sharp indenter is used with respect to a small-diameter and spherical object, an object to which an external additive is attached, or an object having irregularities on the surface, such as a toner, the measurement accuracy is greatly affected. The maximum load of the test is set to $2.0\times10^{-4}$N. By setting this test load, it is possible to measure the hardness without fracturing the surface layer of the toner under the condition corresponding to the stress applied to one toner particle in the developing portion. In the present invention, since friction resistance is important, the hardness is measured while maintaining the surface layer without fracture.

The particle to be measured is selected such that the toner alone is present on the measurement screen (field size: 160 μm width, 120 μm length) of a microscope provided with the apparatus. However, in order to eliminate the displacement error as much as possible, a particle having a particle diameter (D) in the range of ±0.5 μm of the number average particle diameter (D1) ($D1-0.5\ \mu m \le D \le D1+0.5\ \mu m$) is selected. The particle diameter of the particles to be measured is measured by measuring the major axis and minor axis of the toner using software provided with the apparatus, and taking [(major axis+minor axis)/2] as the particle diameter D (μm). Further, the number average particle diameter is measured by using "Coulter Counter Multisizer 3 (manufactured by Beckman Coulter, Inc.)" by a method described hereinbelow.

The measurement is performed by selecting at random 100 toner particles with a particle diameter D (μm) satisfying the above conditions. The conditions inputted at the time of measurement are as follows.

Test mode: load-unloading test

Test load: $2.0\times10^{-4}$N

Number of divisions: 1000 steps

Step interval: 10 msec

When the measurement is performed by selecting "Data Analysis (ISO)" from the analysis menu, the Martens hardness is analyzed and outputted after the measurement by the software provided with the apparatus. The above measurement is performed on 100 toner particles, and the arithmetic average value is defined as the Martens hardness in the present invention.

By adjusting the Martens hardness to at least 200 MPa and not more than 1100 MPa when measured under the condition of a maximum load on the toner of $2.0\times10^{-4}$ N, it was possible to reduce the deformation of the toner in the cleaning nip as compared with the conventional toner. That is, the contact surface area between the cleaning blade and the photosensitive drum can be kept small, and the torque can be further reduced.

When the Martens hardness is 200 MPa or more, a torque reduction effect over a longer period can be exhibited. Meanwhile, where the Martens hardness is 1100 MPa or less, the effect of suppressing the toner slip-through over a longer period can be exhibited.

The means for adjusting the Martens hardness to at least 200 MPa and not more than 1100 MPa when measured under the condition of a maximum load of $2.0\times10^{-4}$ N is not particularly limited. However, since the hardness is significantly higher than the hardness of organic resins used in typical toners, the aforementioned hardness is difficult to achieve with means usually used to increase the hardness. For example, the required hardness is difficult to achieve by a means for designing a resin with a high glass transition temperature, a means for increasing the resin molecular weight, a means for performing thermal curing, a means for adding a filler to the surface layer, and the like.

The Martens hardness of an organic resin used for a general toner is about 50 MPa to 80 MPa when measured under the condition of a maximum load of $2.0\times10^{-4}$N. Furthermore, even when the hardness is increased by the resin design or by increasing the molecular weight, the hardness is about 120 MPa or less. Further, even when a filler such as a magnetic body or a silicon compound is filled in the vicinity of the surface layer and thermally cured, the hardness is about 180 MPa or less, and the toner is significantly harder than a general toner.

Method for Controlling Hardness

For example, a method for forming the surface layer of the toner of a substance such as an inorganic substance having an appropriate hardness and then controlling the chemical structure or the macrostructure thereof to obtain an appropriate hardness is one of the means for adjusting to the abovementioned specific hardness range.

As a specific example, an organosilicon polymer can be mentioned as a substance having the above-mentioned specific hardness, and the hardness can be adjusted by the number of carbon atoms directly bonded to a silicon atom of the organosilicon polymer, the carbon chain length, and the like as a material selection.

It is preferable that the toner particle have a surface layer including an organosilicon polymer, and the number of carbon atoms directly bonded to a silicon atom of the organosilicon polymer be at least 1 and not more than 3 (preferably at least 1 and not more than 2, and more preferably 1), because it is easy to adjust to the specific hardness.

As means for adjusting the Martens hardness by the chemical structure, it is possible to adjust the chemical structure such as the crosslinking and the degree of polymerization of the surface layer material. As a means for adjusting the Martens hardness by the macrostructure, it is possible to adjust the surface layer unevenness and the network structure connecting the protrusions. When an organosilicon polymer is used as a surface layer, these adjustments can be made by adjusting the pH, concentration, temperature, time, and the like when pretreating the organosilicon polymer. Further, the adjustment can be also performed by the timing, form, concentration, reaction temperature, and the like when coating the organosilicon polymer on the core particle of the toner particle.

The following method is particularly preferable in the present invention. First, core particles of toner particles are produced and dispersed in an aqueous medium to obtain a core particle-dispersed solution. The dispersion is preferably performed a concentration at this time such that the solid fraction of the core particles is at least 10% by mass and not more than 40% by mass with respect to the total amount of the core particle-dispersed solution. The temperature of the core particle-dispersed solution is preferably adjusted to 35° C. or higher. The pH of the core particle dispersion is preferably adjusted to a pH at which the condensation of the organosilicon compound does not proceed easily. Since the pH at which the condensation of the organosilicon polymer does not proceed easily differs depending on the substance, the pH is preferably within ±0.5 of the pH at which the reaction is most difficult to proceed.

Meanwhile, it is preferable to use a hydrolyzed organosilicon compound. For example, the organosilicon compound is hydrolyzed in a separate container as a pretreatment. The preparation concentration for hydrolysis is preferably at least 40 parts by mass and not more than 500 parts by mass, and more preferably at least 100 parts by mass and not more than 400 parts by mass of water from which ion component has been removed, such as ion exchanged water or RO water, when the amount of the organosilicon compound is 100 parts by mass. The hydrolysis conditions are preferably a pH of 2 to 7, a temperature of 15° C. to 80° C., and a time of 30 min to 600 min.

By mixing the obtained hydrolysate and the core particle-dispersed solution and adjusting the pH to be suitable for condensation (preferably 6 to 12, or 1 to 3, more preferably 8 to 12), it is possible to form a surface layer on the core particle surface of the toner particle while causing condensation of the organosilicon compound. The condensation and surface layer formation are preferably performed at 35° C. or higher for 60 min or longer. In addition, the macrostructure of the surface can be adjusted by adjusting the holding time at 35° C. or higher before adjusting to a pH suitable for condensation, but in order to easily obtain a specific Martens hardness, an interval at least 3 min and not more than 120 min is preferable.

By the means as described above, the amount of the reaction residue can be reduced, irregularities can be formed on the surface layer, and a network structure can be formed between the projections, so that it is easy to obtain a toner having the specific Martens hardness.

When a surface layer including an organosilicon polymer is used, the fixing ratio of the organosilicon polymer on the surface of the toner particle is preferably at least 90% and not more than 100%, and more preferably at least 95% and not more than 100%. A method for measuring the fixing ratio of the organosilicon polymer on the surface of the toner particle will be described hereinbelow.

Surface Layer Including Organosilicon Polymer

When the toner particle has a surface layer including an organosilicon polymer, the preferred structure is represented by the formula (1).

$$R—SiO_{3/2} \qquad \text{Formula (1)}$$

(R represents a hydrocarbon group having at least 1 and not more than 6 carbon atoms.)

Method for Preparing THF-Insoluble Fraction of Toner Particles for NMR Measurement The tetrahydrofuran (THF)-insoluble fraction of toner particles was prepared in the following manner.

A total of 10.0 g of toner particles were weighed, placed into a cylindrical filter paper (No. 86R manufactured by Toyo Filter Paper K.K.) and put in a Soxhlet extractor. Extraction was carried out for 20 h using 200 mL of THE as a solvent, and the dry product obtained by vacuum drying the filtrate in the cylindrical filter paper at 40° C. for several hours was used as the THF-insoluble fraction of the toner particles for NMR measurement.

Where the surface of the toner particle has been treated with an external additive or the like, the external additive is removed by the following method to obtain the toner particle.

A total of 160 g of sucrose (manufactured by Kishida Chemical Co., Ltd.) is added to 100 mL of ion exchanged water, and dissolved while heating with hot water to prepare a sucrose concentrated solution. A total of 31 g of the sucrose concentrated solution and 6 mL of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) are placed in a centrifuge tube (capacity 50 mL) to prepare a dispersion liquid. A total of 1.0 g of the toner is added to the dispersion liquid and the toner lump is loosened with a spatula or the like.

The centrifuge tube is shaken with a shaker at 350 spm (strokes per min) for 20 min. After shaking, the solution is transferred into a glass tube for a swing rotor (capacity 50 mL) and separated by a centrifuge (H-9R, manufactured by KOKUSAN Co., Ltd.) at 3500 rpm for 30 min. By this operation, the toner particles are separated from the detached external additive. It is visually confirmed that the toner and the aqueous solution are sufficiently separated, and the toner separated in the uppermost layer is collected with a spatula or the like. The collected toner is filtered with a vacuum filter and then dried with a dryer for 1 h or longer to obtain toner particles. This operation is performed multiple times to ensure the required amount.

Confirmation Method of Structure Shown by Formula (1)

The following method is used to confirm the structure represented by the formula (1) in the organosilicon polymer included in the toner particle.

The hydrocarbon group represented by R in the formula (1) was confirmed by $^{13}$C-NMR.

Measurement Conditions for $^{13}$C-NMR (Solid)
Apparatus: JNM-ECX500II manufactured by JEOL RESONANCE Co., Ltd.
Sample tube: 3.2 mmΦ
Sample: 150 mg of tetrahydrofuran-insoluble fraction of toner particles for NMR measurement
Measurement temperature: room temperature
Pulse mode: CP/MAS
Measurement nuclear frequency: 123.25 MHz ($^{13}$C)
Reference substance: adamantane (external standard: 29.5 ppm)
Sample rotation speed: 20 kHz
Contact time: 2 ms
Delay time: 2 s
Integration count: 1024 times In this method, a hydrocarbon group represented by R in the formula (1) was confirmed by the presence or absence of a signal due to a methyl group (Si—$CH_3$), an ethyl group (Si—$C_2H_5$), a propyl group (Si—$C_3H_7$), a butyl group (Si—$C_4H_9$), a pentyl group (Si—$O_5H_{11}$), a hexyl group (Si—$C_6H_{13}$) or a phenyl group (Si—$C_6CH_5$—) bonded to a silicon atom.

Calculation Method of Proportion of Peak Area Attributed to Structure of Formula (1) in Organosilicon Polymer Included in Toner Particle The measurement of $^{29}$Si-NMR (solid) of the THF-insoluble fraction of toner particles is performed under the following measurement conditions.

Measurement Conditions for $^{29}$Si-NMR (Solid)
Apparatus: JNM-ECX500II manufactured by JEOL RESONANCE Co., Ltd.
Sample tube: 3.2 mmΦ
Sample: 150 mg of tetrahydrofuran-insoluble fraction of toner particles for NMR measurement
Measurement temperature: room temperature
Pulse mode: CP/MAS
Measurement nuclear frequency: 97.38 MHz ($^{29}$Si)
Reference substance: DSS (external standard: 1.534 ppm)
Sample rotation speed: 10 kHz
Contact time: 10 ms
Delay time: 2 s
Integration count: 2000 times to 8000 times After the measurement, a plurality of silane components having different substituents and bonding groups in the tetrahydrofuran-insoluble fraction of the toner particles are separated into peaks by curve fitting into the following structure X1, structure X2, structure X3, and structure X4.

Structure $X1$: $(Ri)(Rj)(Rk)SiO_{1/2}$ (2)

Structure $X2$: $(Rg)(Rh)Si(O_{1/2})_2$ (3)

Structure $X3$: $RmSi(O_{1/2})_3$ (4)

Structure $X4$: $Si(O_{1/2})_4$ (5)

X1 Structure:

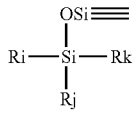

(2)

X2 Structure:

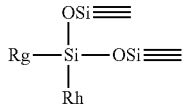

(3)

X3 Structure:

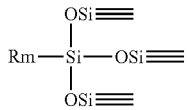

(4)

X4 Structure:

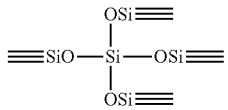

(5)

(Ri, Rj, Rk, Rg, Rh, and Rm in the formulas (2), (3) and (4), represent an organic group such as a hydrocarbon group having 1 to 6 carbon atoms, a halogen atom, a hydroxy group, an acetoxy group or an alkoxy group bonded to silicon.)

In addition, when it is necessary to confirm the structure represented by the above formula (1) in greater detail, the structure may be identified by the measurement result of together with the measurement result of $^{13}$C-NMR and $^{29}$Si-NMR.

In the organosilicon polymer having the structure of the formula (1), one of the four valences of the Si atom is bonded to R, and the remaining three are bonded to O atoms. The O atoms constitute a state in which two valences are both bonded to Si, that is, a siloxane bond (Si—O—Si). Considering Si atoms and O atoms of the organosilicon polymer, since there are three 0 atoms for two Si atoms, the representation is by $—SiO_{3/2}$. It is conceivable that the $—SiO_{3/2}$ structure of the organosilicon polymer has properties similar to silica ($SiO_2$) composed of a large number of siloxane bonds. Therefore, it is conceivable that the Martens hardness can be increased because of the structure which is closer to the inorganic substance as compared to the toner in which the surface layer is formed by the conventional organic resin.

In the structure represented by the formula (1), R is preferably a hydrocarbon group having at least 1 and not more than 6 carbon atoms. In such a case, the charge quantity is likely to be stable. In particular, an aliphatic hydrocarbon group having at least 1 and not more than 5 carbon atoms, or a phenyl group which is excellent in environmental stability is preferable.

In addition, it is more preferable that R be a hydrocarbon group having at least 1 and not more than 3 carbon atoms for further improving the charging performance When the charging performance is good, the transfer property is good and the amount of residual toner is small, so that the contamination of the drum, the charging member and the transfer member is reduced.

Preferred examples of the hydrocarbon group having at least 1 and not more than 3 carbon atoms include a methyl group, an ethyl group, a propyl group, and a vinyl group. From the viewpoints of environmental stability and storage stability, R is more preferably a methyl group.

As a production example of the organosilicon polymer, a sol-gel method is preferable. The sol-gel method is a method in which a liquid raw material is used as a starting material for hydrolysis and condensation polymerization, and gelation is performed through a sol state. This method is used for synthesizing glass, ceramics, organic-inorganic hybrids, and nanocomposites. By using this production method, functional materials having various shapes such as surface layers, fibers, bulk bodies, and fine particles can be produced from a liquid phase at a low temperature.

Specifically, the organosilicon polymer present in the surface layer of the toner particle is preferably produced by hydrolysis and polycondensation of a silicon compound typified by an alkoxysilane.

By providing the toner particle with a surface layer including this organosilicon polymer, environmental stability is improved, the toner performance is less likely to deteriorate during long-term use, and a toner having excellent storage stability can be obtained.

Furthermore, since the sol-gel method starts with a liquid and forms a material by gelling the liquid, various fine structures and shapes can be created. In particular, where a toner particle is produced in an aqueous medium, precipitation on the surface of the toner particle is facilitated due to the hydrophilicity created by a hydrophilic group such as a silanol group of the organosilicon compound. The fine structure and shape can be adjusted by the reaction temperature, reaction time, reaction solvent, pH, type and amount of the organometallic compound, and the like.

The organosilicon polymer of the surface layer of the toner particle is preferably a polycondensation product of an organosilicon compound having a structure represented by a following formula (Z).

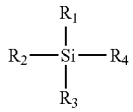

(Z)

(In the formula (Z), $R_1$ represents a hydrocarbon group having at least 1 and not more than 6 carbon atoms, and $R_2$, $R_3$, and $R_4$ each independently represent a halogen atom, a hydroxy group, an acetoxy group, or an alkoxy group.)

The hydrophobicity can be improved by the hydrocarbon group (preferably an alkyl group) of $R_1$, and a toner particle having excellent environmental stability can be obtained. Further, an aryl group, which is an aromatic hydrocarbon group, such as a phenyl group, can also be used as the hydrocarbon group. Since charge quantity fluctuation in various environments tends to increase when the hydrophobicity of $R_1$ is large, in view of environmental stability, $R_1$ is preferably a hydrocarbon group having at least 1 and not more than 3 carbon atoms, and more preferably a methyl group.

$R_2$, $R_3$, and $R_4$ are each independently a halogen atom, a hydroxy group, an acetoxy group, or an alkoxy group (hereinafter also referred to as a reactive group). These reactive groups are hydrolyzed, addition-polymerized and condensation-polymerized to form a crosslinked structure, and a toner having excellent resistance to member contamination and development durability can be obtained. The hydrolyzation ability is moderate at room temperature, and from the viewpoint of precipitation on the surface of toner particle and coverage, an alkoxy group having at least 1 and not more than 3 carbon atoms is preferable, and a methoxy group or an ethoxy group is more preferable. The hydrolysis, addition polymerization and condensation polymerization of $R_2$, $R_3$, and $R_4$ can be controlled by the reaction temperature, reaction time, reaction solvent and pH.

In order to obtain the organosilicon polymer used in the present embodiment, organosilicon compounds having three reactive groups ($R_2$, $R_3$, and $R_4$) in one molecule excluding $R_1$ in the formula (Z) shown above (hereinafter, referred to as trifunctional silane) may be used alone or in combination of a plurality thereof.

Further, the amount of the organosilicon polymer in the toner particle is preferably at least 0.5% by mass and not more than 10.5% by mass.

Where the amount of the organosilicon polymer is 0.5% by mass or more, the surface free energy of the surface layer can be further reduced, the flowability is improved, and the occurrence of member contamination or fogging can be suppressed. Where the amount is 10.5% by mass or less, it is possible to make it difficult for charge-up to occur. The amount of the organosilicon polymer is controlled by the type and amount of the organosilicon compound used for forming the organosilicon polymer, a method for producing the toner particles at the time of forming the organosilicon polymer, the reaction temperature, reaction time, reaction solvent and pH.

The surface layer including the organosilicon polymer and the toner core particle are preferably in contact with each other without any gap. As a result, the occurrence of bleeding of the resin component, release agent and the like located on the inner side of the toner particle with respect to the surface layer can be suppressed, and a toner having excellent storage stability, environmental stability, and development durability can be obtained. In addition to the above organosilicon polymer, the surface layer may include a resin such as a styrene-acrylic copolymer resin, a polyester resin, an urethane resin, various additives, and the like.

Method for Producing Toner Particles

As a method for producing toner particles, known means can be used, and a kneading and pulverizing method or a wet production method can be used. From the viewpoint of uniform particle diameter and shape controllability, a wet production method can be preferably used. Furthermore, examples of the wet production method include a suspension polymerization method, a dissolution suspension method, an emulsion polymerization aggregation method, and an emulsion aggregation method.

Here, the suspension polymerization method will be described. In the suspension polymerization method, first, a polymerizable monomer for producing a binder resin and, if necessary, a colorant and other additives are uniformly dissolved or dispersed using a disperser such as a ball mill or an ultrasonic disperser to prepare a polymerizable monomer composition (step of preparing a polymerizable monomer composition). At this time, a polyfunctional monomer, a chain transfer agent, a wax as a release agent, a charge control agent, a plasticizer, and the like can be added as necessary.

Next, the polymerizable monomer composition is put into an aqueous medium prepared in advance, and droplets made of the polymerizable monomer composition are formed into toner particles of desired size by using a stirrer or a disperser having a high shearing force (granulation step).

It is preferable that the aqueous medium in the granulation step include a dispersion stabilizer in order to control the particle diameter of the toner particles, sharpen the particle size distribution, and suppress coalescence of the toner particles in the production process.

Dispersion stabilizers are generally roughly classified into polymers that develop a repulsive force due to steric hindrance and poorly water-soluble inorganic compounds that achieve dispersion stabilization with an electrostatic repulsive force. The fine particles of the hardly water-soluble inorganic compound are preferably used because they are dissolved by an acid or an alkali and can be easily dissolved and removed by washing with an acid or an alkali after polymerization.

After the granulation step or while performing the granulation step, the temperature is preferably set to at least 50° C. and not more than 90° C. to polymerize the polymerizable monomer contained in the polymerizable monomer composition, and a toner particle-dispersed solution is obtained (polymerization step).

In the polymerization step, it is preferable to perform a stirring operation so that the temperature distribution in the container be uniform. Where a polymerization initiator is added, the addition can be performed at arbitrary timing and for a required time. In addition, the temperature may be raised in the latter half of the polymerization reaction for the purpose of obtaining a desired molecular weight distribution. Furthermore, in order to remove the unreacted polymerizable monomer, by-products and the like from the system, part of the aqueous medium may be removed by distillation operation in the latter half of the reaction or after completion of the reaction. The distillation operation can be performed under normal or reduced pressure.

The toner particle-dispersed solution thus obtained is sent to a filtration step for solid-liquid separation of the toner particles and the aqueous medium.

Solid-liquid separation for obtaining toner particles from the obtained toner particle-dispersed solution can be carried out by a general filtration method. Thereafter, in order to remove foreign matter that could not be removed from the toner particle surface, it is preferable to perform reslurrying or further washing with running washing water or the like. After sufficient washing has been performed, solid-liquid separation is performed again to obtain a toner cake. Thereafter, the toner cake is dried by a known drying means, and if necessary, a particle group having a particle diameter outside the predetermined range is separated by classification to obtain toner particles. The separated particles having a particle diameter outside the predetermined range may be reused to improve the final yield.

In the case of forming a surface layer having an organosilicon polymer, when forming toner particles in an aqueous medium, the hydrolysate of the organosilicon compound can be added, as described above, to form the surface layer while performing a polymerization step or the like in an aqueous medium. The surface layer may be also formed by using the toner particle-dispersed solution after polymerization as a core particle-dispersed solution and adding the hydrolysate of the organosilicon compound. Further, in the case of not using an aqueous medium, such as in a kneading pulverization method, the surface layer can be formed by dispersing the obtained toner particles in an aqueous medium to be used as a core particle-dispersed solution, and adding the hydrolysate of the organosilicon compound as described hereinabove.

Measurement of Particle Diameter of Toner (Particle)

A precision particle size distribution measuring device (trade name: Coulter Counter Multisizer 3) based on a pore electric resistance method and dedicated software (trade name: Beckman Coulter Multisizer 3, Version 3.51, manufactured by Beckman Coulter, Inc.) were used. The aperture diameter was 100 μm, the measurement was performed with 25,000 effective measurement channels, and the measurement data were analyzed and calculated. "ISOTON II" (trade name) manufactured by Beckman Coulter, Inc., which is a solution prepared by dissolving special grade sodium chloride in ion exchanged water to a concentration of about 1% by mass, was used as the electrolytic aqueous solution for measurements. The dedicated software was set up in the following manner before the measurement and analysis.

The total count number in a control mode was set to 50.000 particles on a "CHANGE STANDARD MEASUREMENT METHOD (SOM) SCREEN" of the dedicated software, the number of measurements was set to 1, and a value obtained using ("standard particles 10.0 μm", manufactured by Beckman Coulter, Inc.) was set as a Kd value. The threshold and the noise level were automatically set by pressing a measurement button of threshold/noise level. Further, the current was set to 1600 μA, the gain was set to 2, the electrolytic solution was set to ISOTON II (trade name), and flush of aperture tube after measurement was checked.

In the "PULSE TO PARTICLE DIAMETER CONVERSION SETTING SCREEN" of the dedicated software, the bin interval was set to a logarithmic particle diameter, the particle diameter bin was set to a 256-particle diameter bin, and a particle diameter range was set at least 2 μm and not more than 60 μm.

The specific measurement method is described hereinbelow.

(1) Approximately 200 mL of the electrolytic aqueous solution was placed in a glass 250 mL round-bottom beaker dedicated to Multisizer 3, the beaker was set in a sample stand, and stilling with a stirrer rod was carried out counterclockwise at 24 revolutions per second. Dirt and air bubbles in the aperture tube were removed by the "FLUSH OF APERTURE TUBE" function of the dedicated software.

(2) About 30 mL of the electrolytic aqueous solution was placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water was added thereto.

(3) A predetermined amount of ion exchanged water and about 2 mL of the CONTAMINON N (trade name) were added in the water tank of an ultrasonic disperser (trade name: Ultrasonic Dispersion System Tetora 150, manufactured by Nikkaki Bios Co. Ltd.) with an electrical output of 120 W in which two oscillators with an oscillation frequency of 50 kHz are built in with a phase shift of 180 degrees.

(4) The beaker of (2) hereinabove was set in the beaker fixing hole of the ultrasonic disperser, and the ultrasonic disperser was actuated. Then, the height position of the beaker was adjusted so that the resonance state of the liquid surface of the electrolytic aqueous solution in the beaker was maximized.

(5) About 10 mg of the toner (particles) was added little by little to the electrolytic aqueous solution and dispersed therein in a state in which the electrolytic aqueous solution in the beaker of (4) hereinabove was irradiated with ultrasonic waves. Then, the ultrasonic dispersion process was further continued for 60 sec. In the ultrasonic dispersion, the water temperature in the water tank was appropriately adjusted to a temperature of at least 10° C. and not more than 40° C.

(6) The electrolytic aqueous solution of (5) hereinabove in which the toner (particles) was dispersed was dropped using a pipette into the round bottom beaker of (1) hereinabove which was set in the sample stand, and the measurement concentration was adjusted to be about 5%. Then, measurement was conducted until the number of particles to be measured reached 50,000.

(7) The measurement data were analyzed with the dedicated software provided with the apparatus, and the weight average particle diameter (D4) was calculated. The "AVERAGE DIAMETER" on the analysis/volume statistical value (arithmetic mean) screen when the dedicated software was set to graph/volume % was the weight average particle diameter (D4). The "AVERAGE DIAMETER" on the analysis/number statistical value (arithmetic mean) screen when the dedicated software was set to graph/number % was the number average particle diameter (D1).

Method for Measuring Adhesion Ratio of Organosilicon Polymer

A total of 160 g of sucrose (manufactured by Kishida Chemical Co., Ltd.) is added to 100 mL of ion exchanged water and dissolved while forming a hot water bath to prepare a concentrated sucrose solution. Then, 31 g of the concentrated sucrose solution and 6 mL of CONTAMINON N (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) are placed in a centrifuge tube (capacity 50 mL) to prepare a dispersion liquid. To this dispersion liquid, 1.0 g of the toner is added, and the lump of the toner is loosened with a spatula or the like.

The centrifuge tube is shaken with a shaker at 350 spm (strokes per min) for 20 min. After shaking, the solution is transferred to a Mass tube for a swing rotor (capacity 50 mL), and separated by a centrifuge (H-9R manufactured by Kokusan Co., Ltd.) at 3500 rpm for 30 min. It is visually confirmed that the toner and the aqueous solution are sufficiently separated, and the toner separated in the uppermost layer is collected with a spatula or the like. The aqueous solution including the collected toner particles is filtered with a vacuum filter and then dried with a dryer for 1 h or longer. The dried product is crushed with a spatula, and the amount of silicon is measured with fluorescent X-rays. The fixing ratio (%) is calculated from the silicon amount ratio of the measurement target of the toner particles after washing and the toner particles before washing.

The measurement of fluorescent X-rays of each element conforms to JIS K 0119-1969, and is specifically as follows.

A wavelength dispersive X-ray fluorescence analyzer "Axios" (manufactured by PANalytical) and dedicated software "SuperQ ver. 4.0F" (manufactured by PANalytical) provided therewith are used as the measurement device. Rh is used as the anode of the X-ray tube, the measurement atmosphere is vacuum, the measurement diameter (collimator mask diameter) is 10 mm, and the measurement time is 10 sec. Further, when measuring a light element, the element is detected by a proportional counter (PC), and when measuring a heavy element, the element is detected by a scintillation counter (SC).

A pellet to be used as a measurement sample is prepared by placing about 1 g of washed toner particles and initial toner particles in a dedicated aluminum ring having a diameter of 10 mm for pressing, leveling the toner, and pressing with a tablet molding compressor "BRE-32" (manufactured by Maekawa Test Instruments Co., Ltd.) for 60 sec under 20 MPa to form a tablet having a thickness of about 2 mm.

The measurement is performed under the above conditions, the elements are identified based on the obtained X-ray peak positions, and the concentration thereof is calculated from the count rate (unit: cps) which is the number of X-ray photons per unit time.

As a method for quantitative determination in the toner particle, for example, for the silicon amount, silica ($SiO_2$) fine powder is added to constitute 0.5 parts by mass with respect to 100 parts by mass of the toner particles, and sufficient mixing is performed using a coffee mill. Similarly, the silica fine powder is mixed with the toner particles so as to constitute 2.0 parts by mass and 5.0 parts by mass, respectively, and resulting samples are used as samples for a calibration curve.

For each sample, the pellet of the sample for a calibration curve is prepared as described above using a tablet molding compressor, and a count rate (unit: cps) of Si-Kα rays observed at a diffraction angle (2θ) of 109.08° when using PET as a spectroscopic crystal is measured. At this time, the acceleration voltage and current value of the X-ray generator are set to 24 kV and 100 mA, respectively. A calibration curve in the form of a linear function is obtained by plotting the obtained X-ray count rate on the ordinate and plotting the added amount of $SiO_2$ in each sample for a calibration curve on the abscissa.

Next, the toner particles to be analyzed are pelletized as described above using the tablet molding compressor, and the count rate of the Si-Kα rays is measured. Then, the amount of the organosilicon polymer in the toner particle is determined from the above calibration curve. The ratio of the element amount in the toner particle after washing to the element amount in the toner particle before washing calculated by the above method is obtained and designated as the fixing ratio (%).

External Additive

The toner particles can be made into toner without external additives, but in order to improve flowability, charging performance, cleaning properties, and the like, so-called external additives such as a fluidizing agent, a cleaning aid, and the like may be added to obtain a toner.

Examples of the external additive include inorganic oxide fine particles composed of alumina fine particles, titanium oxide fine particles, and the like, inorganic stearic acid compound fine particles such as aluminum stearate fine particles, zinc stearate fine particles, and the like, and inorganic titanic acid compound fine particles such as strontium titanate, zinc titanate and the like. These can be used alone or in combination of two or more.

These inorganic fine particles are preferably subjected to surface treatment with a silane coupling agent, a titanium coupling agent, a higher fatty acid, silicone oil or the like in order to improve heat-resistant storage stability and environmental stability. The BET specific surface area of the external additive is preferably at least 10 $m^2/g$ and not more than 450 $m^2/g$.

The BET specific surface area can be determined by a low-temperature gas adsorption method using a dynamic constant pressure method according to a BET method (preferably a BET multipoint method). For example, the BET specific surface area ($m^2/g$) can be calculated by using a specific surface area measuring device (trade name: GEMINI 2375 Ver. 5.0, manufactured by Shimadzu Corporation), causing nitrogen gas adsorption on the sample surface, and performing measurement using the BET multipoint method.

The total addition amount of these various external additives is preferably at least 0.05 parts by mass and not more than 5 parts by mass, and more preferably at least 0.1 parts by mass and not more than 3 parts by mass with respect to 100 parts by mass of the toner particles. Further, various external additives may be used in combination.

The toner may have a positively charged particle on the surface of the toner particle. The number average particle diameter of the positively charged particles is preferably at least 0.10 μm and not more than 1.00 μm, and more preferably at least 0.20 μm and not more than 0.80 μm.

It was made clear that where such positively charged particles are present, good transfer efficiency is achieved through durable use. This is conceivably because the positively charged particles having such a particle diameter can roll on the surface of the toner particles and are rubbed between the photosensitive drum and the transfer belt to promote negative charging of the toner, which results in suppression of conversion to a positive charge by the application of transfer bias. The toner of the present invention is characterized by a hard surface, and since positively charged particles are not easily adhered to or buried on the surface of the toner particle, it is possible to maintain high transfer efficiency.

The positively charged particles in the present invention are particles that are positively charged when triboelectrically charged by mixing and stirring with a standard carrier (anionic: N-01) provided by the Imaging Society of Japan.

The number average particle diameter of the external additive is measured using a scanning electron microscope "S-4800" (manufactured by Hitachi, Ltd.). The toner with the external additive externally added thereto is observed, and the major axis of 100 primary particles of the external additive is randomly measured in the field of view enlarged to a maximum of 200,000 times to determine the number average particle diameter. The observation magnification is adjusted, as appropriate, according to the size of the external additive.

Various methods are conceivable as means for causing positively charged particles to be present on the surface of the toner particle, and any method may be used, but a method of attaching by external addition is preferred. It was found that where the Martens hardness of the toner is within the range of the present invention, the positively charged particles can be caused to be uniformly present on the surface of the toner particles. The fixing ratio of the positively charged particles to the toner particle is preferably at least 5% and not more than 75%, and more preferably at least 5% and not more than 50%. When the fixing ratio is within this range, it is possible to maintain high transfer efficiency by promoting triboelectric charging of the toner particles and positively charged particles. A method for measuring the fixing ratio will be described hereinbelow.

As the kind of positively charged particles, hydrotalcite, titanium oxide, a melamine resin and the like are preferable. Of these, hydrotalcite is particularly preferable.

Method for Measuring Adhesion Ratio of Positively Charged Particle

In the method for measuring the fixing ratio of the organosilicon polymer, the element to be measured is designated as an element contained in a positively charged particle. For example, in the case of hydrotalcite, magnesium and aluminum are the elements to be measured. In other aspects, the fixing ratio of positively charged particles is measured by the same method.

The produced toners are described hereinbelow. Here, "parts" of all materials are based on mass unless otherwise specified. In the following description, the numbers 1 to 6 attached to the toner are for distinguishing the types thereof, similarly to photosensitive drums 1 to 4 and cleaning blades 1 to 5, and are different from the reference numerals "10" in other explanations or drawings.

Toner 1

Step of Preparing Aqueous Medium 1

A total of 14.0 parts of sodium phosphate (RASA Industries, Ltd., dodecahydrate) was added to 1000.0 parts of ion exchanged water in a reaction vessel, and kept at 65° C. for 1.0 h while purging with nitrogen.

An aqueous calcium chloride solution obtained by dissolving 9.2 parts of calcium chloride (dihydrate) in 10.0 parts of ion exchanged water was loaded while stirring at 12,000 rpm using a T. K. Homomixer (manufactured by Tokushu Kikα Kogyo Co., Ltd.) to prepare an aqueous medium including a dispersion stabilizer. Furthermore, 10% by mass hydrochloric acid was added to the aqueous medium, and the pH was adjusted to 5.0, whereby an aqueous medium 1 was obtained.

Step of Hydrolyzing Organosilicon Compound for Surface Layer

In a reaction vessel equipped with a stirrer and a thermometer, 60.0 parts of ion exchanged water was weighed and the pH was adjusted to 3.0 using 10% by mass hydrochloric acid. Heating was then performed under stirring to bring the temperature to 70° C. Thereafter, 40.0 parts of methyltriethoxysilane, which is an organosilicon compound for the surface layer, was added and stirred for 2 h or longer to conduct hydrolysis. The end point of hydrolysis was visually confirmed by the formation of a single layer, without separation, of oil and water, and cooling was performed to obtain a hydrolysate of the organosilicon compound for the surface layer.

Step of Preparing Polymerizable Monomer Composition

| | |
|---|---|
| Styrene | 60.0 parts |
| C. I. Pigment Blue 15:3 | 6.5 parts |

The aforementioned materials were put into an attritor (manufactured by Mitsui Miike Chemical Engineering Machinery, Co., Ltd.), and further dispersed using zirconia particles having a diameter of 1.7 mm at 220 rpm for 5.0 h to prepare a pigment-dispersed solution. The following materials were added to the pigment-dispersed solution.

| | |
|---|---|
| Styrene | 20.0 parts |
| n-Butyl acrylate | 20.0 parts |
| Crosslinking agent (divinylbenzene) | 0.3 parts |
| Saturated polyester resin (Polycondensation product of propylene oxide-modified bisphenol A (2 mol adduct) and terephthalic acid (molar ratio 10:12), glass transition temperature Tg = 68° C., weight average molecular weight Mw = 10,000, molecular weight distribution Mw/Mn = 5.12) | 5.0 parts |
| Fischer-Tropsch wax (melting point 78° C.) | 7.0 parts |

This resulting mixture was kept at 65° C. and uniformly dissolved and dispersed at 500 rpm using a T. K. Homomixer (manufactured by Tokushu Kikα Kogyo Co., Ltd.) to prepare a polymerizable monomer composition.

Granulation Step

The polymerizable monomer composition was loaded into the aqueous medium 1 while maintaining the temperature of the aqueous medium 1 at 70° C. and the rotational speed of the T. K. Homomixer at 12000 rpm, and 9.0 parts of t-butyl peroxypivalate as a polymerization initiator was added. The mixture was granulated for 10 min while maintaining 12,000 rpm of the stirring device.

Polymerization Step

After the granulation step, the stirrer was replaced with a propeller stirring blade and polymerization was performed for 5.0 h while maintaining at 70° C. under stirring at 150 rpm, and then polymerization reaction was carried out by raising the temperature to 85° C. and heating for 2.0 h to obtain core particles. When the pH of the slurry was measured after cooling to 55° C., the pH was 5.0. With the stirring continued at 55° C., 20.0 parts of the hydrolysate of the organosilicon compound for the surface layer was added to start the surface layer formation on the toner. After maintaining as is for 30 min, the slurry was adjusted to pH=9.0 for completion of condensation by using an aqueous sodium hydroxide solution and further maintained for 300 min to form a surface layer.

Washing and Drying Step

After completion of the polymerization step, the toner particle slurry was cooled, hydrochloric acid was added to the toner particle slurry to adjust the pH to 1.5 or lower, the slurry was allowed to stand under stirring for 1 h, and then solid-liquid separation was performed with a pressure filter to obtain a toner cake. The toner cake was reslurried with ion exchanged water to obtain a dispersion again, followed by solid-liquid separation with the above-mentioned filter. Reslurrying and solid-liquid separation were repeated until the electric conductivity of the filtrate became 5.0 μS/cm or less, and finally solid-liquid separation was performed to obtain a toner cake.

The obtained toner cake was dried with an air flow drier FLASH JET DRIER (manufactured by Seishin Enterprise Co., Ltd.), and fine particles were cut using a multi-division classifier utilizing the Coanda effect to obtain a toner particle 1. The drying conditions were a blowing temperature of 90° C. and a dryer outlet temperature of 40° C., and the supply speed of the toner cake was adjusted so that the outlet temperature did not deviate from 40° C. according to the moisture content of the toner cake.

In the cross-sectional TEM observation of the toner particle 1, silicon mapping was performed, and it was confirmed that silicon atoms were present on the surface layer. In the subsequent toner production examples, for the surface layer including the organosilicon polymer, it was also confirmed by the same silicon mapping that silicon atoms were present in the surface layer. In this production example, the obtained toner particles 1 were used as a toner 1 as they were, without external addition.

Methods for evaluating the toner 1 will be described below.

Measurement of Martens Hardness

The measurement was performed by the method described in the "Method for Measuring Martens Hardness of Toner" described above.

Method for Measuring Adhesion Ratio

The measurement was performed by the method described in the "Method for Measuring Adhesion Ratio of Organosilicon Polymer" described above.

Toner 2, Toner 3

The toners were prepared in the same manner as the toner 1 except that the conditions at the time of adding the hydrolysate in the polymerization step and the retention time after the addition were changed as shown in Table 7. The pH of the slurry was adjusted with hydrochloric acid and aqueous sodium hydroxide solution. Table 7 shows the measurement results for the obtained toner 2 and toner 3.

Toner 4

External addition to the toner 1 was performed as shown in Table 8 to prepare toner 4. In the external addition method, an external additive was placed in SUPERMIXER PICCOLO SMP-2 (manufactured by Kawata Co., Ltd.) in the number of parts, with respect to 100 parts of the toner particles, shown in Table 8, and mixing was performed at 3000 rpm for 10 min. Table 7 shows the measurement results for the obtained toner 4.

Toner 5

A toner 5 was prepared in the same manner as the toner 1 except that the conditions at the time of adding the hydrolysate in the polymerization step and the retention time after the addition were changed as shown in Table 7. Table 7 shows the evaluation results of the obtained toner.

Toner 6

The step of hydrolyzing organosilicon compound for surface layer was not performed. Instead, 30 parts of methyltriethoxysilane of the organosilicon compound for the surface layer was added as a monomer (step of preparing polymerizable monomer composition).

In the polymerization step, after cooling to 70° C. and measuring the pH, no hydrolysate was added. While the stirring was continued at 70° C., the slurry was adjusted to pH=9.0 for completion of condensation by using an aqueous sodium hydroxide solution and was maintained for 300 min to form a surface layer. Otherwise, the toner was prepared in the same manner as toner 1. Table 7 shows the evaluation results of the obtained toner 6.

TABLE 7

| | Number of added parts of polymerization initiator | Number of added parts of crosslinking agent | Type of organosilicon compound for surface layer | Fixing ratio of organosilicon compound (%) | Martens hardness (MPa) |
|---|---|---|---|---|---|
| Toner 1 | 9.0 | 0.3 | Methyltriethoxysilane | 97 | 598 |
| Toner 2 | | | | 96 | 203 |
| Toner 3 | | | | 95 | 1092 |
| Toner 4 | | | | 97 | 598 |
| Toner 5 | | | | 91 | 1200 |
| Toner 6 | | | | 85 | 153 |

| | Conditions at the time of hydrolysate addition | | | Conditions after the addition of hydrolysate |
|---|---|---|---|---|
| | Slurry pH | Slurry temperature | Number of added parts of hydrolysate | Retention time until pH adjustment for condensation completion |
| Toner 1 | 5.0 | 55 | 20.0 | 30 |
| Toner 2 | 9.0 | 70 | 20.0 | 0 |
| Toner 3 | 5.0 | 40 | 20.0 | 90 |
| Toner 4 | 5.0 | 55 | 20.0 | 30 |
| Toner 5 | 5.0 | 35 | 20.0 | 150 |
| Toner 6 | Added in step of preparing a polymerizable monomer, without hydrolysis. See the present text. | | | |

TABLE 8

| | External addition | Contents | Particle diameter of external additive (μm) | Number of parts of external additive | Fixing ratio of external additive (%) |
|---|---|---|---|---|---|
| Toner 1, Toner 2, Toner 3 | None | | | | |
| Toner 4 | DHT-4A | Positively charged particles: hydrotalcite | 0.25 | 0.2 | 10 |
| Toner 5, Toner 6 | None | | | | |

In the table, DHT-4A (registered trademark) is manufactured by Kyowa Chemical Industry Co., Ltd.

EXAMPLE

In Examples 1 to 21 of Embodiment 2 and Comparative Examples 1 and 2, combinations of cleaning blades 1 to 5 and photosensitive drums 1 to 4, such as shown in Table 9, were prepared.

Tests

Torque

The developer storage chamber 18*b* of the process cartridge 7 was filled with 100 g of the toner. Similarly, the cleaning blades and photosensitive drums of Examples 1 to 21 and Comparative Examples 1 and 2 were attached to the photosensitive member unit 13, the set angle θ of the cleaning blade was set to 20°, and the penetration amount δ was set to 1.0 mm.

In a state of contact with the developing roller in an environment with a room temperature of 15° C. and a relative humidity of 10% Rh, a voltage of −1 kV was applied to the charging roller, the developing roller was grounded, and a voltage of −100 kV was applied to the supply roller and the regulating member, while rotating at a photosensitive member surface speed of 296 mm/s and a developing roller surface speed of 425 mm/s.

The photosensitive member driving torque within 2 sec after 30 sec from the start of rotation was measured. Evaluation was performed as follows.

A: satisfactory low torque property (0.16 N·m or less)

B: low torque effect is present (more than 0.16 N·m and equal to or less than 0.18 N·m)

C: low torque effect is present (more than 0.18 N·m and equal to or less than 0.20 N·m)

F: low torque effect is not observed (more than 0.20 N·m)

Combinations evaluated as A, B and C were considered to have an effect of reducing torque. The results are shown in the "Torque" column of Table 9.

Toner Slip-Through

The image forming apparatus 100 was used to form 150,000 prints of images with a print percentage of 1% in an environment with a room temperature of 15° C. and a relative humidity of 10% Rh. An intermittent time of 3 seconds was provided for every two images formed. The photosensitive member surface speed was 296 mm/s, the developing roller surface speed was 425 mm/s, the photosensitive member surface potential was −500 V, the voltage applied to the developing roller was −350 V, the supply roller voltage was −450 V, and the regulating member voltage was −450 V. The slip-through of the toner after the formation of 150,000 images was evaluated. Evaluation was performed as follows.

A: there is no visible dirt on the photosensitive member surface and no effect on the image B: there is practically no visible dirt on the photosensitive member surface and no effect on the image C: light toner slip-through is visually observed on the photosensitive member surface, but there is no effect on the image F: there is visible dirt on the photosensitive member surface and also effect on the image The effect on the image is considered to be an occurrence of streaks due to toner slip-through in the recording material conveyance direction on a white image. The results are shown in the "Toner slip-through" column in Table 9. A, B and C in which there is no effect on the image were regarded as demonstrating the effect of the invention.

TABLE 9

| | Photo-sensitive drum No. | Cleaning blade No. | Toner No. | Torque | Toner slip-through |
|---|---|---|---|---|---|
| Example 1 | 1 | 1 | 1 | B | A |
| Example 2 | | | 2 | B | A |
| Example 3 | | | 3 | A | B |
| Example 4 | | | 4 | B | A |
| Example 5 | | 2 | 1 | A | A |
| Example 6 | | | 2 | B | A |
| Example 7 | | | 3 | A | B |
| Example 8 | | | 4 | A | A |
| Example 9 | | 3 | 1 | B | A |
| Example 10 | | | 2 | B | B |
| Example 11 | | | 3 | A | A |
| Example 12 | | | 4 | A | B |
| Example 13 | | 1 | 5 | A | C |
| Example 14 | | | 6 | C | A |
| Example 15 | | 2 | 5 | A | C |
| Example 16 | | | 6 | C | A |
| Example 17 | | 3 | 5 | A | C |
| Example 18 | | | 6 | C | A |
| Example 19 | | 4 | 1 | A | C |
| Example 20 | | 5 | | C | A |
| Example 21 | 2 | 1 | | C | A |
| Comparative Example 1 | 3 | | | B | F |
| Comparative Example 2 | 4 | | | F | F |

As described above, in a preferable example, the average height (Rpk) of the ridges of the projections above the core section of the roughness curve of the peripheral surface of the photosensitive drum is set to 0.02 μm or less, the average depth (Rvk) of the valleys of the projections under the core section of the roughness curve of the peripheral surface of the photosensitive drum is set to 0.08 μm or less, and the dynamic hardness DHs of the cleaning blade is set at least 0.07 and not more than 1.1. As a result, it is possible to further suppress the toner slip-through while realizing a low torque.

This is because where the average height (Rpk) of the ridges of the projections above the core section of the roughness curve of the peripheral surface of the photosensitive drum is set to 0.02 μm or less, the surface area of the contact portion of the cleaning blade and the photosensitive drum is reduced and the torque lowering effect can be obtained. Meanwhile, where the average depth (Rvk) of the valleys of the projections under the core section of the roughness curve of the peripheral surface is set to 0.08 μm or less, a gap larger than the toner particle diameter is unlikely to be formed between the cleaning blade and the drum. Further, by setting the dynamic hardness DHs of the cleaning blade to 0.07 to 1.1 in this state, a sufficient pressure can be applied between the cleaning blade and the photosensitive drum, and the slip-through can be further suppressed.

In addition, when the Martens hardness of the toner is controlled to at least 200 MPa and not more than 1100 MPa, it is possible to suppress scratches on the surface of the photosensitive drum caused by paper passing, and the surface roughness of the photosensitive drum attained at the initial stage can be maintained over a longer lifetime. As a result, the life of the image forming apparatus can be further extended.

In Example 13, since the Martens hardness of the toner was high, the toner easily entered the nip portion of the cleaning blade, and the toner slip-through suppression effect was somewhat reduced.

In Example 14, since the Martens hardness of the toner was low, the toner was less likely to enter the nip portion of the cleaning blade, and the torque reduction effect was somewhat reduced.

In Example 15, since the Martens hardness of the toner was high, the toner easily entered the nip portion of the cleaning blade, and the toner slip-through suppression effect was somewhat reduced.

In Example 16, since the Martens hardness of the toner was low, the toner was less likely to enter the nip portion of the cleaning blade, and the torque reduction effect was somewhat reduced.

In Example 17, since the Martens hardness of the toner was high the toner easily entered the nip portion of the cleaning blade, and the toner slip-through suppression effect was somewhat reduced.

In Example 18, since the Martens hardness of the toner was low, the toner was less likely to enter the nip portion of the cleaning blade, and the torque reduction effect was somewhat reduced.

In Example 19, since the dynamic hardness DHs of the cleaning blade was low, the surface pressure easily decreased at the nip portion between the cleaning blade and the photosensitive drum, the toner entered the nip portion, and certain toner slip-through occurred.

In Example 20, since the dynamic hardness DHs of the cleaning blade was high, the surface pressure increased at the nip portion between the cleaning blade and the photosensitive drum, and the torque reduction effect was somewhat reduced.

In Example 21, the average height (Rpk) of the ridges of the projections above the core section of the roughness curve of the peripheral surface of the photosensitive drum was large, the contact surface area between the cleaning blade and the photosensitive drum was not sufficiently narrow and the torque reduction effect was somewhat reduced.

In Comparative Example 1, the average depth (Rvk) of the valleys of the projections under the core section of the roughness curve of the peripheral surface of the photosensitive drum was large, a gap between the cleaning blade and the photosensitive drum was generated, and the toner slip-through could not be suppressed.

In Comparative Example 2, the average height (Rpk) of the ridges of the projections above the core section of the roughness curve of the peripheral surface of the photosensitive drum was large, the contact surface area between the cleaning blade and the photosensitive drum was not sufficiently narrow, and the torque could not be lowered sufficiently. Further, since (Rpk+Rk+Rvk) was as large as 0.25, the gap at the nip between the cleaning blade and the photosensitive drum was large, and the toner slip-through could not be suppressed.

As described above, according to the present embodiment, by controlling the variables related to the roughness curve of the peripheral surface of the electrophotographic photosensitive member, it is possible to suppress the toner slip-through from the cleaning blade where the driving torque of the photosensitive drum is reduced. As a result, it is possible to provide an image forming apparatus in which image problems caused by contamination of a charging member do not occur.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-213876, filed on Nov. 14, 2018, which is hereby incorporated by reference herein in its entirety.

What is claimed is:

1. An image forming apparatus comprising:

a cylindrical image bearing member including a cylindrical support and an organic photosensitive layer provided on the cylindrical support;

a developing member configured to supply a developer to the image bearing member for developing a latent image formed on a peripheral surface of the image bearing member; and a cleaning member configured to clean the peripheral surface in contact with the peripheral surface of the image bearing member, wherein a plurality of grooves extend in a circumferential direction on the peripheral surface of the image bearing member, and have a width in a generatrix direction of the peripheral surface within a range of at least 0.5 μm and not more than 40 μm, and are formed to be side by side in the generatrix direction;

the number of the grooves is at least 20 and not more than 1000 per a width of 1000 μm in the generatrix direction of the peripheral surface of the image bearing member; and an average depth (Rvk) of a valley of a projection under a core section of a roughness curve of the peripheral surface of the image bearing member is 0.08 μm or less.

2. The image forming apparatus according to claim 1, wherein an average height (Rpk) of a ridge of the projection above the core section of the roughness curve of the peripheral surface of the image bearing member is at least 0.01 μm and not more than 0.02 μm.

3. The image forming apparatus according to claim 2, wherein a sum of the average height (Rpk) of the ridge of the projection above the core section of the roughness curve of the peripheral surface of the image bearing member, a height (Rk) of a core portion forming a center of the roughness curve of the peripheral surface of the image bearing member, and the average depth (Rvk) of the valley of the projection under the core section of the roughness curve of the peripheral surface of the image bearing member is 0.24 μm or less.

4. The image forming apparatus according to claim 1, wherein in a cross section perpendicular to a rotation axis of the image bearing member, an angle, between an opposite plane of the cleaning member and a tangent line passing through a virtual point on the peripheral surface of the image bearing member, is designated as a set angle θ, the opposite plane is a place facing the peripheral surface of the image bearing member on a downstream side of an edge of the cleaning member in a rotation direction of the image bearing member when the cleaning member is disposed with respect to the image bearing member so that the edge of the cleaning member is in contact with the virtual point, and a penetration amount of the cleaning member, when the cleaning member is moved so as to penetrate with respect to the image bearing member in a direction perpendicular to the tangent line from the virtual point, is denoted by δ, following conditions are satisfied, $$18 \leq \theta \leq 26(°), \text{ and}$$

$$0.6 \leq \delta \leq 1.4(\text{mm}).$$

5. The image forming apparatus according to claim 1, wherein a dynamic hardness DHs of a contact portion of the cleaning member in contact with the image bearing member satisfies the following condition:

$$0.07(\text{mN}/\mu\text{m}^2) \leq DHs \leq 1.1(\text{mN}/\mu\text{m}^2).$$

6. The image forming apparatus according to claim 1, wherein the developer includes a toner having a toner particle, the toner particle has a surface layer including an organosilicon polymer having a structure represented by a following formula (1), a fixing ratio of the organosilicon polymer on a surface of the toner particle is 90% or more, and the toner has a Martens hardness of at least 200 MPa and not more than 1100 MPa when measured under a maximum load of $2.0 \times 10^{-4}$ N, $$R—SiO_{3/2} \qquad \text{Formula (1)}$$

wherein R is a hydrocarbon group having at least 1 and not more than 6 carbon atoms.

7. The image forming apparatus according to claim 6, wherein a weight average particle diameter of the toner is at least 3.0 μm and not more than 10.0 μm.

8. The image forming apparatus according to claim 1 further comprising:

a frame which rotatably supports the image bearing member and to which the cleaning member is fixed, wherein the cleaning member includes an elastic portion and a support portion that supports the elastic portion;

a first end of the elastic portion is fixed to the support portion, and a second end of the elastic portion, which is a free end, is in contact with the peripheral surface of the image bearing member;

a first end of the support portion is fixed to the frame, and the elastic portion is fixed to a second end of the support portion, which is a free end;

a direction extending from the first end of the support portion to the second end of the elastic portion is opposite to a rotation direction of the image bearing member at a portion where the second end of the support portion is in contact with the peripheral surface of the image bearing member.

9. The image forming apparatus according to claim 1, wherein in a posture when using, the image bearing member rotates so that the peripheral surface moves in a direction from an upper side toward a lower side at a portion where the cleaning member is in contact with the peripheral surface of the image bearing member.

* * * * *